US011920432B2

(12) United States Patent
Mackay

(10) Patent No.: US 11,920,432 B2
(45) Date of Patent: Mar. 5, 2024

(54) TOE VALVE WITH VENTED ATMOSPHERIC CHAMBER

(71) Applicant: DOWNHOLE PRODUCTS LIMITED, Aberdeen (GB)

(72) Inventor: Alexander Craig Mackay, Aberdeen (GB)

(73) Assignee: DOWNHOLE PRODUCTS LIMITED

( * ) Notice: Subject to any disclaimer, the term of this patent is extended or adjusted under 35 U.S.C. 154(b) by 19 days.

(21) Appl. No.: 17/767,106

(22) PCT Filed: Nov. 9, 2020

(86) PCT No.: PCT/IB2020/060541
§ 371 (c)(1),
(2) Date: Apr. 7, 2022

(87) PCT Pub. No.: WO2021/144632
PCT Pub. Date: Jul. 22, 2021

(65) Prior Publication Data

US 2022/0364438 A1 Nov. 17, 2022

Related U.S. Application Data

(60) Provisional application No. 62/960,986, filed on Jan. 14, 2020.

(51) Int. Cl.

| | |
|---|---|
| ***E21B 34/10*** | (2006.01) |
| ***E21B 33/14*** | (2006.01) |
| ***E21B 34/14*** | (2006.01) |
| ***E21B 47/117*** | (2012.01) |

(52) U.S. Cl.
CPC ..... *E21B 34/103* (2013.01); *E21B 33/14* (2013.01); *E21B 34/14* (2013.01); *E21B 47/117* (2020.05)

(58) Field of Classification Search
CPC ..... E21B 34/103; E21B 47/117; E21B 33/14; E21B 34/14; E21B 34/142; E21B 34/102; E21B 34/063; E21B 34/08; E21B 2200/06
See application file for complete search history.

(56) References Cited

U.S. PATENT DOCUMENTS

| | | | | |
|---|---|---|---|---|
| 9,133,684 | B2 | 9/2015 | Hofman | |
| 9,476,282 | B2 | 10/2016 | Anton | |
| 9,752,412 | B2 * | 9/2017 | Shkurti | E21B 34/10 |
| 9,816,350 | B2 | 11/2017 | Mailand | |
| 11,428,073 | B2 * | 8/2022 | Mackay | E21B 33/14 |

(Continued)

*Primary Examiner* — Yong-Suk (Philip) Ro

(57) ABSTRACT

A toe valve for use in a wellbore includes: a tubular mandrel; a housing extending along a periphery of the mandrel; couplings for assembly as part of a casing or liner string; and a valve piston. The valve piston is: disposed in an annulus formed between the housing and the mandrel, movable between an open position and a closed position, and disposed between a valve port of the housing and a valve port of the mandrel in the closed position. The toe valve further includes: an atmospheric chamber for facilitating movement of the valve piston to the open position; a vent port formed through the housing and in fluid communication with the atmospheric chamber; and a flow control device disposed in the vent port and operable to prevent fluid flow from the wellbore into the atmospheric chamber and allow fluid flow from the atmospheric chamber into the wellbore.

20 Claims, 11 Drawing Sheets

(56) References Cited

U.S. PATENT DOCUMENTS

| | | | | |
|---|---|---|---|---|
| 2012/0279723 | A1* | 11/2012 | Hofman | E21B 34/063 166/373 |
| 2015/0369008 | A1* | 12/2015 | Shaffer | E21B 43/116 166/305.1 |
| 2016/0090815 | A1 | 3/2016 | Kennedy | |
| 2016/0177667 | A1* | 6/2016 | Kellner | E21B 34/12 166/321 |
| 2016/0237781 | A1 | 8/2016 | Bacsik | |
| 2017/0268313 | A1* | 9/2017 | Harris | E21B 34/102 |
| 2019/0195048 | A1 | 6/2019 | Tveranger | |
| 2020/0263519 | A1 | 8/2020 | Roberts | |
| 2020/0284123 | A1 | 9/2020 | Tveranger | |
| 2020/0408068 | A1 | 12/2020 | Mackay | |
| 2021/0270107 | A1 | 9/2021 | Mackay | |

* cited by examiner

TOE VALVE WITH VENTED ATMOSPHERIC CHAMBER

BACKGROUND OF THE DISCLOSURE

Field of the Disclosure

The present disclosure generally relates to a toe valve with a vented atmospheric chamber.

Description of the Related Art

U.S. Pat. No. 9,133,684 discloses a downhole tool including an inner sleeve with a plurality of sleeve ports and a housing positioned radially outwardly of the inner sleeve and having a plurality of housing ports, with the housing and inner sleeve partially defining a space radially therebetween. The space is occupied by a shifting sleeve. A fluid path extends between the interior flowpath of the tool and the space. A fluid control device, occupies at least portion of the fluid path, and may selectively permit fluid flow, and thus pressure communication, into the space to cause a differential pressure across the shifting sleeve. When a sufficient differential pressure is reached, the shifting sleeve is moved from a first position to a second position, which opens the communication paths through the housing and sleeve ports between the interior flowpath and exterior of the tool.

U.S. Pat. No. 9,476,282 discloses a smooth bore toe valve including a first sub defining a through bore and a fluid flow path through a wall thereof; a second sub; a housing mechanically engaged with the first and second subs to define a valve cavity axially between the first and second subs and to define a chamber radially between the first and second subs and the housing, the housing further defining a plurality of openings in a wall thereof; and a sleeve disposed within the chamber between the housing and the first and second subs to close the openings and, upon application of fluid pressure horn the through bore through the fluid this path, open the openings to fluid flow from the valve cavity to the exterior of the housing.

U.S. Pat. No. 9,752,412 discloses a toe valve having an outer tubular member, including at least one outer flow port, and an inner tubular member positioned at least partially within the outer tubular member and including a central flow passage. An indexing mechanism is positioned within the outer tubular member and there is a flow path allowing fluid pressure from the central passage to act against a first side of the indexing mechanism. A biasing device acts on a second side of the indexing mechanism and the indexing mechanism is configured to allow communication between the central flow passage and the outer flow port after the indexing mechanism is subject to a plurality of pressure cycles within the central flow passage.

U.S. Pat. No. 9,816,350 discloses a ported sub operated with a pressure actuated shifting sleeve. A first rupture disc is set at a lower pressure than the test pressure for the tubing string that houses the ported sub. The first rupture disc breaks at a lower pressure than the string test pressure to expose well fluids to a disintegrating plug. The plug slowly disintegrates to then expose tubing pressure to a chamber and a second rupture disc with the chamber configured to have no effect on moving the sliding sleeve. When the tubing pressure is then raised to a predetermined pressure below the test pressure for the string, the second disc breaks exposing a piston to tubing pressure on one side and trapped low pressure being the opposite side of the string. The differential moves the sleeve to open a port to let tools be pumped into position without a need to perforate.

US 2016/0090815 discloses an interior sleeve that blocks fluid flow through ports in the housing. The inner sleeve is coupled to a j-slot so that a pressurization cycle will move the inner sleeve and cause the inner sleeve to rotate a predetermined distance. Upon reaching the access position in the j-slot the sleeve is allowed to move to a fully open position. Additionally when the inner sleeve is in a pressurized position the inner sleeve is supported so that high pressure in excess of the pressure required to actuate a pressure cycle may be applied without damage to the toe sleeve or inner sleeve.

US 2016/0237781 discloses a downhole tool, such as a toe sleeve, having an insert movably disposed in the housing's bore and sealably enclosing a second part of the communication path from a first port. A barrier disposed between the first and second parts of the communication path is breachable in response to a level of the applied pressure in the housing's bore. At least one retainer is engaged between the insert and the housing and at least temporarily retains the insert toward a closed position. The at least one retainer is at least partially composed of a dissolvable material and at least partially dissolves in response to the applied pressure communicated through the communication path to the second part. The at least one retainer when at least partially dissolved permits the applied pressure to initiate movement of the insert, such as from a closed position toward an opened position.

US 2017/0268313 discloses a tool including a housing between an outer wall and an inner wall that surrounds a longitudinal tool bore. First and second axially spaced ports connect the housing to the tool bore. An unlocking piston seals across the first port and an arming sleeve seats across the second port. A locking ring is held in place by a retaining ring and prevents the arming sleeve from sliding towards the unlocking piston to open the second port. An unlocking tool bore pressure at the first port moves the unlocking piston axially to displace the retaining ring and unlock the tool. A lower, arming tool bore pressure moves the arming sleeve in the unlocked tool to open the second port and arms the tool. An actuating tool bore pressure, which is less that the unlocking pressure, actuates a valve piston via the open second port.

US 2020/0263519 discloses a toe valve housing one or more of tracer or dye compounds and a method of monitoring the operation of a toe valve. The toe valve has an atmospheric chamber disposed between a sleeve and a pressure barrier and contains one or more of tracer or dye compounds in an amount sufficient to be observed from water or other wellbore fluids when released to the fluids. The tracer compound is released from the atmospheric chamber as a pressure barrier is activated and open. The released tracer or dye compounds can be identified from the water or other wellbore fluids. Also included are methods of monitoring the operation of a toe valve in a wellbore.

WO 2017/204657 discloses a toe valve including; a housing having an interior and exterior; a sliding sleeve; a counter mechanism comprising a cylinder, a ratchet piston with first and second ends, and a ratchet shaft connected to the second end; a trigger assembly comprising a trigger housing, and a release piston, wherein the trigger assembly is arranged between the counter mechanism and the sliding sleeve, and wherein the release piston is configured to activate the sliding sleeve, and the ratchet shaft is configured to activate the release piston, wherein the toe valve further includes: a closed chamber enclosing the ratchet shaft) and defined at least partly by the cylinder comprising a chamber fluid with a chamber pressure; an inlet pressure port configured to be in communication with a wellbore fluid with a wellbore pressure, and wherein the first end of the ratchet piston is in fluid communication with the inlet pressure port, wherein the ratchet piston is configured to move towards the trigger assembly to a new position and compress the chamber fluid when the wellbore pressure is larger than the chamber pressure; a retaining mechanism configured to retain the ratchet shaft in the new position; and a valve mechanism interconnecting the first and second ends of the ratchet piston and configured for equalizing the pressure across the ratchet piston.

SUMMARY OF THE DISCLOSURE

The present disclosure generally relates to a toe valve with a vented atmospheric chamber. In one embodiment, a toe valve for use in a wellbore includes: a tubular mandrel; a housing extending along a periphery of the mandrel; couplings at longitudinal ends of the toe valve for assembly as part of a casing or liner string; a valve piston disposed in an annulus formed between the housing and the mandrel, movable between an open position and a closed position, and disposed between a valve port of the housing and a valve port of the mandrel in the closed position; an atmospheric chamber for facilitating movement of the valve piston to the open position; a vent port formed through the housing and in fluid communication with the atmospheric chamber; and a flow control device disposed in the vent port and operable to prevent fluid flow from the wellbore into the atmospheric chamber and allow fluid flow from the atmospheric chamber into the wellbore.

In another embodiment, a toe valve for use in a wellbore includes: a tubular mandrel; a housing extending along a periphery of the mandrel; couplings at longitudinal ends of the toe valve for assembly as part of a casing or liner string; a valve piston disposed in an annulus formed between the housing and the mandrel, movable between an open position and a closed position, disposed between a valve port of the housing and a valve port of the mandrel in the closed position, and having a face in fluid communication with a bore of the mandrel; a hydraulic activator disposed in a wall of the housing for locking the valve piston in the closed position in a first mode and for releasing the valve piston in a second mode; hydraulic fluid disposed in the annulus between the valve piston and the hydraulic activator; and an atmospheric chamber in fluid communication with the hydraulic activator.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
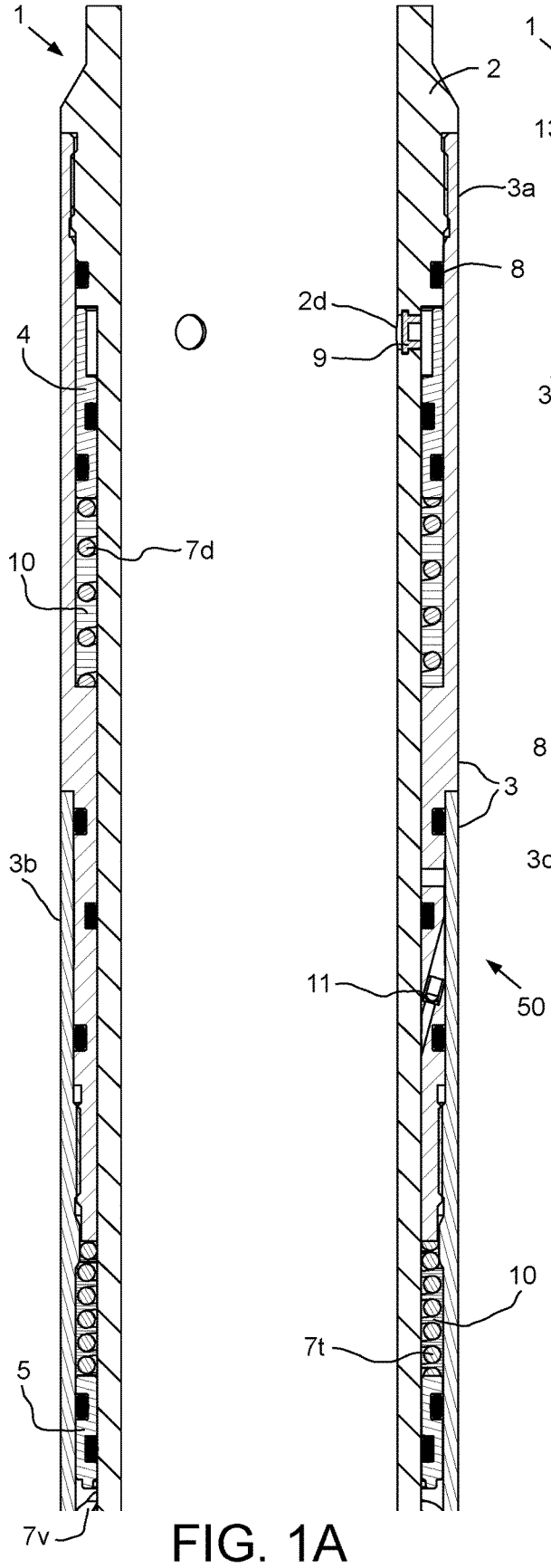
FIGS. 1A and 1B illustrate a first toe valve with a vented atmospheric chamber in a closed position, according to one embodiment of the present disclosure.
Figure 1B:
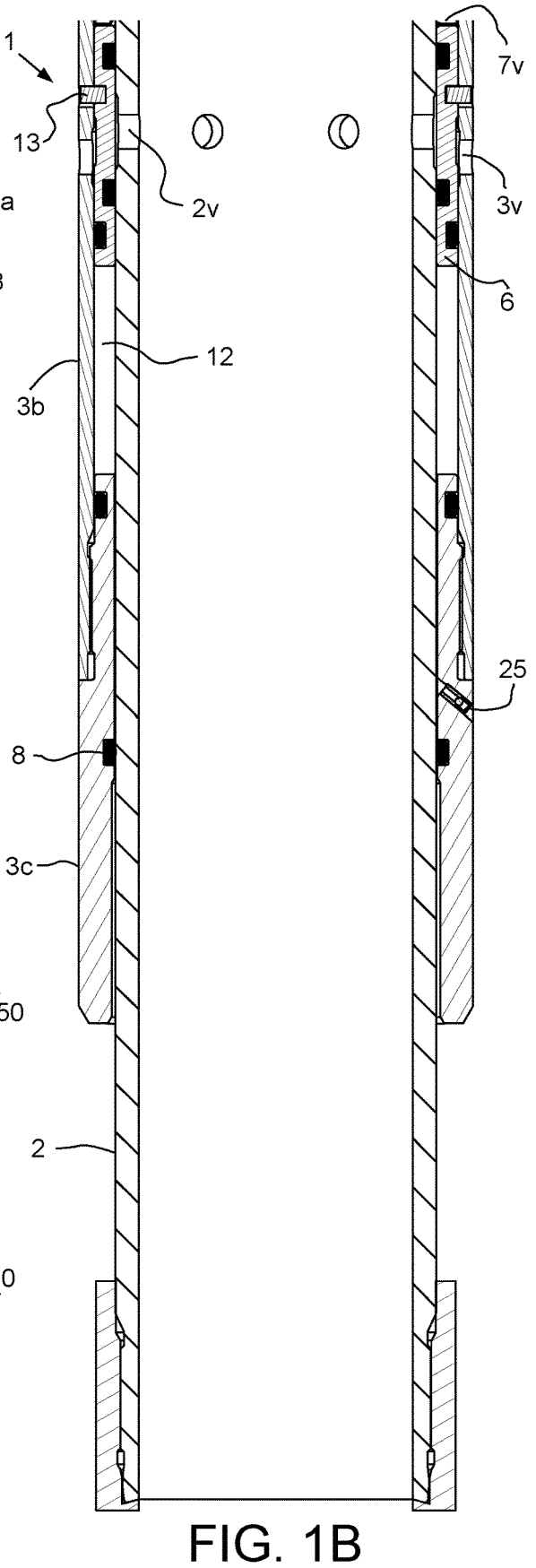

FIGS. 1A and 1B illustrate a first toe valve 1 with a vented atmospheric chamber 12 in a closed position, according to one embodiment of the present disclosure. The toe valve 1 may include a mandrel 2, a housing 3, a drive piston 4, a trigger piston 5, a valve piston 6, and one or more springs 7*d,t,v*. The mandrel 2 may be a tubular member having a longitudinal bore formed therethrough and couplings, such as threads (only lower thread shown), formed at longitudinal ends thereof for assembly of the toe valve 1 as part of a casing string or liner string.

The housing 3 may be a sleeve including a plurality of sections 3*a-c* extending along the mandrel 2. The mandrel 2 may have a boss formed in a periphery thereof and an upper longitudinal end of the upper housing section 3*a* may be mounted thereto, such as by a threaded connection. An interface between the mandrel 2 and the upper housing section 3*a* may be sealed, such as by an elastomeric o-ring 8, carried in a groove formed in the mandrel boss. The upper housing section 3*a* may have an enlarged diameter upper portion, a reduced diameter lower portion, and an increased thickness mid portion connecting the upper and lower portions. An upper annulus may be formed longitudinally between the boss of the mandrel 2 and the mid portion of the upper housing section 3*a* and radially between the upper portion of the upper housing section and a periphery of the mandrel.

The drive piston 4 may be disposed in the upper annulus and may divide the upper annulus into an upper bore chamber and a lower hydraulic drive chamber. The drive piston 4 may be annular and may carry inner and outer seals, such as elastomeric o-rings 8, in respective inner and outer grooves formed therein. The drive piston 4 may also have an inner recess formed in an upper portion thereof which may facilitate fluid communication with the mandrel bore. The mandrel 2 may have one or more (two shown) drive ports 2*d* formed through a wall thereof adjacent to a top of the upper annulus to provide fluid communication between the mandrel bore and the upper bore chamber. A debris excluder, such as a rupture disk 9, may be disposed in each upper drive port 2*d* and mounted to the mandrel 2, thereby closing the drive ports and isolating the mandrel bore from the bore chamber. The drive rupture disks 9 may have a set pressure greater than a cementing pressure and a testing pressure.

Hydraulic fluid 10, such as refined and/or synthetic oil, may be disposed in the hydraulic drive chamber. For simplicity, the hydraulic fluid 10 is shown in FIGS. 1A and 1B and depicted in FIGS. 2A and 2B with an arrow, though it remains in the hydraulic chambers throughout shifting of the first toe sleeve 1. The drive spring 7*d* may be a compression spring, such as a coil spring, and may also be disposed in the hydraulic drive chamber and may have an upper end bearing against the drive piston 4 and a lower end bearing against the upper housing section 3*a*, thereby biasing the drive piston toward the mandrel boss. The mid housing section 3*b* may overlap the lower portion of the upper housing section 3*a* and a top of the mid housing section may abut the mid portion of the upper housing section.

The lower portion of the upper housing section 3*a* may include a hydraulic activator 50 having a radial hydraulic port formed through a wall thereof and an angled hydraulic port formed through the wall thereof. A hydraulic pressure control device, such as a rupture disk 11, may be disposed in the angled hydraulic port and may be mounted to the lower portion of the upper housing section 3*a* thereby closing the angled hydraulic port and isolating the hydraulic drive chamber from a hydraulic trigger chamber. The hydraulic rupture disk 11 may have a set pressure greater than the cementing pressure and the testing pressure. The radial hydraulic port may be in fluid communication with the hydraulic drive chamber via an unsealed portion of the interface between the upper housing section 3*a* and the mandrel 2. The radial hydraulic port may be in fluid communication with the angled hydraulic port via an unsealed portion of the interface between the upper housing section 3*a* and the mid housing section 3*b*. The angled hydraulic port may be in fluid communication with the hydraulic trigger chamber via another unsealed portion of the interface between the upper housing section 3*a* and the mandrel 2.

For isolating the hydraulic activator 50 from leakage or bypass, the lower portion of the upper housing section 3*a* may carry an inner seal and a pair of outer seals, such as elastomeric o-rings 8, in respective inner and outer grooves formed therein for the respective interfaces with the mandrel 2 and the mid housing section 3*b*. An upper one of the outer seals may be located above the radial hydraulic port and a lower one of the outer seals may be located adjacent to a lower portion of the angled hydraulic port. The inner seal may be located between the radial and angled hydraulic ports. The mid housing section 3*b* may be mounted to a lower longitudinal end of the upper housing section 3*a*, such as by a threaded connection.

A lower annulus may be formed longitudinally between the bottom of the upper housing section 3*a* and a top of the lower housing section 3*c* and radially between the mid housing section and the periphery of the mandrel 2. The trigger piston 5 and the valve piston 6 may be disposed in the lower annulus and may divide the lower annulus into the upper hydraulic trigger chamber, a mid valve chamber, and a lower atmospheric chamber 12. The trigger piston 5 may be annular and may carry inner and outer seals, such as elastomeric o-rings 8, in respective inner and outer grooves formed therein. The trigger piston 5 may also have inner and outer recesses formed in a lower portion to define a stinger which may facilitate interaction with the valve spring 7*v*. The hydraulic fluid 10 may be disposed in the hydraulic trigger chamber. The trigger spring 7*t* may be a compression spring, such as a coil spring, may also be disposed in the hydraulic trigger chamber, and may have an upper end bearing against the upper housing section 3*a* and a lower end bearing against the trigger piston 5, thereby biasing the trigger piston toward the valve piston 6.

The valve spring 7*v* may be a compression spring, such as a wave spring, may be disposed in the valve chamber, and may have an upper end bearing against the trigger piston 5 and a lower end bearing against the valve piston 6, thereby biasing the trigger piston away from the valve piston. The mandrel 2 may have one or more (four shown) valve ports 2*v* formed through a wall thereof adjacent to a mid-point of the lower annulus to provide fluid communication between the mandrel bore and the valve chamber when the toe valve 1 is in the open position (FIG. 3). The mid housing section 3*b* may have one or more (two shown) valve ports 3*v* formed through a wall thereof adjacent to the mandrel valve ports 2*v* to provide fluid communication between the valve chamber and a cement sheath (not shown) disposed between the toe valve 1 and a periphery of the wellbore when the toe valve is in the open position.

The valve chamber may be in fluid communication with the housing valve ports 3*v* via an unsealed portion of the interface between the valve piston 6 and the mid housing section 3*b*. The valve piston 6 may be releasably connected to the mid housing section 3*b* by one or more (pair shown) shearable fasteners 13. Collectively, the shearable fasteners 13 may be set to withstand a force exerted on an upper face of the valve piston 6 by hydrostatic wellbore pressure acting thereon as the toe sleeve 1 is being deployed into the wellbore. The valve piston 6 may have a groove formed in a periphery thereof for receiving inner portions of the shearable fasteners 13 and the mid housing section 3*b* may have a port formed through the wall thereof for each shearable fastener for receiving an outer portion thereof. The shearable fasteners 13 may be accessible from the exterior of the toe valve 1 for adjustment of the set force thereof while the toe valve is in the oilfield.

The valve piston 6 may be annular and may carry a pair of inner seals and an outer seal, such as elastomeric o-rings 8, in respective inner and outer grooves formed therein. When the valve piston 6 is in the upper kept position, an upper one of the inner seals may be located above the mandrel valve ports 2*v* and a lower one of the inner seals may be located below the mandrel valve ports, thereby isolating the mandrel bore from the valve chamber and the atmospheric chamber 12. When the valve piston 6 is in the upper kept position, the outer seal may be located below the housing valve ports 3*v*, thereby isolating the atmospheric chamber 12 from the wellbore hydrostatic pressure. When the valve piston 6 is in the upper kept position, the trigger spring 7*t* may be in a contracted position and the drive spring 7*d* may be in an extended position.

The lower housing section 3*c* may have a reduced diameter upper portion, an enlarged diameter lower portion, and an increased thickness mid portion connecting the upper and lower portions. The mid housing section 3*b* may overlap the upper portion of the lower housing section 3*c* and a bottom of the mid housing section may abut the mid portion of the lower housing section. For isolating the atmospheric chamber 12, the upper portion of the lower housing section 3*c* may carry an outer seal and the mid portion of the lower housing section may carry an inner seal, such as elastomeric o-rings 8, in respective inner and outer grooves formed therein for the respective interfaces with the mid housing section 3*b* and the mandrel 2.

Should wellbore fluid 26 (FIG. 3A) leak past either of the inner or outer seals of the lower housing section 3*c* and into the atmospheric chamber 12, the lower housing section may be equipped with a vent located between the inner and outer seals of the lower housing section. The vent may include an angled vent port formed through a wall of the lower housing section and a check valve 25 disposed in the angled vent port and mounted to the mid portion of the lower housing section 3*c*. The vent port may be in fluid communication with the atmospheric chamber 12 via an unsealed portion of the interface between the lower housing section 3*c* and the mandrel 2. The check valve 25 may be oriented to prevent flow of wellbore fluid 26 from the wellbore into the atmospheric chamber 12 and allow flow of wellbore fluid from the atmospheric chamber into the wellbore.

Figure 2A:
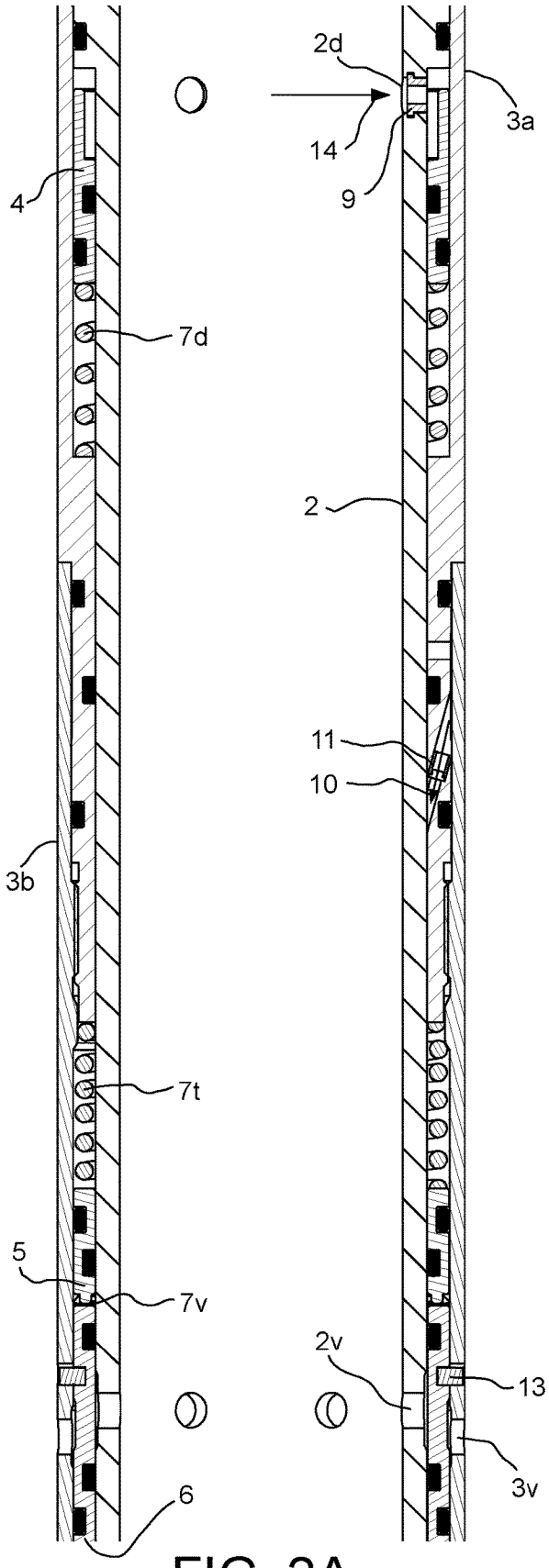
FIG. 2A illustrates the first toe valve in a first intermediate position while shifting from the closed position to an open position.

FIG. 2A illustrates the first toe valve 1 in a first intermediate position while shifting from the closed position to the open position. The toe valve 1 may be assembled as part of a casing string or a liner string and usually located in proximity to a lower end of the string. Once assembled, the casing or liner string is then deployed into the wellbore adjacent to an oil or gas bearing formation. The casing or liner string may then be cemented into position in the wellbore by pumping cement slurry down a bore thereof and up an annulus formed between the casing or liner string and the wellbore. Once the cement slurry has cured into a cement sheath in the wellbore annulus, a pressure test may be performed by pressurizing the bore of the casing or liner string to the testing pressure and holding the testing pressure for a period of time, such as between five minutes and one hour. The toe valve 1 may remain in the closed position during assembly with the casing or liner string, deployment into the wellbore, cementing of the casing or liner string, and pressure testing.

Once the pressure test has concluded, the bore of the casing or liner string may be further pressurized to an overpressure. The overpressure may be greater than the testing pressure which may be greater than the cementing pressure. The overpressure may exceed the testing pressure by an amount ranging between one-hundred five percent and one-hundred twenty-five percent. The overpressure may be equal to or greater than the set pressures of the rupture disks 9, 11. The overpressure may be held until the toe valve 1 shifts from the closed position to the open position.

The drive rupture disks 9 may burst, thereby opening the drive ports 2*d* and providing fluid communication between the mandrel bore and the bore chamber. Pressurized bore fluid 14 may enter the bore chamber and exert a fluid force on upper faces of the drive piston 4. The drive piston 4 in turn may pressurize the hydraulic drive chamber until the hydraulic rupture disk 11 bursts, thereby opening the angled hydraulic port and hydraulically linking the drive piston 4 and the trigger piston 5. The contracted trigger spring 7*t* may be free to extend and pressure by the hydraulic fluid 10 may act in conjunction therewith to move the linked pistons 4, 5 longitudinally downward together and the stinger of the trigger piston 5 may engage the valve spring 7*v*.

Figure 2B:
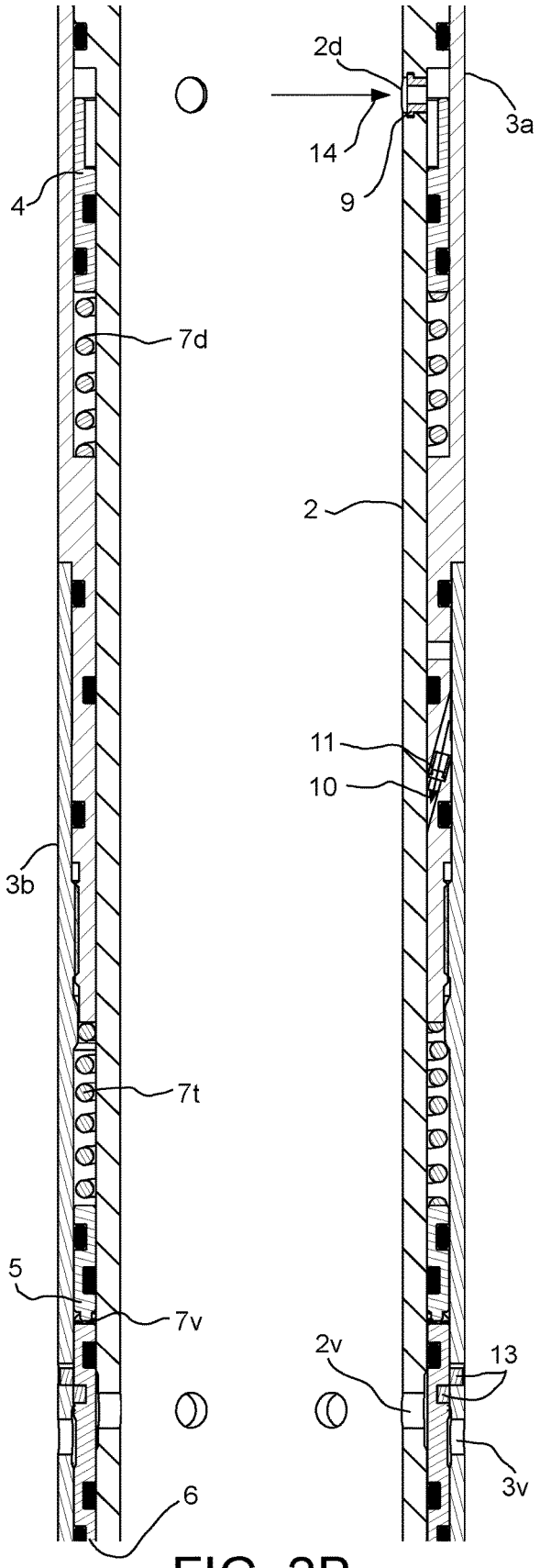
FIG. 2B illustrates the first toe valve in a second intermediate position while shifting from the closed position to the open position.

FIG. 2B illustrates the first toe valve 1 in a second intermediate position while shifting from the closed position to the open position. Contraction of the valve spring 7*v* may exert force on the valve piston 6 and the shearable fasteners 13, thereby fracturing the shearable fasteners and releasing the valve piston from the mid housing section 3*b*.

Figure 3A:
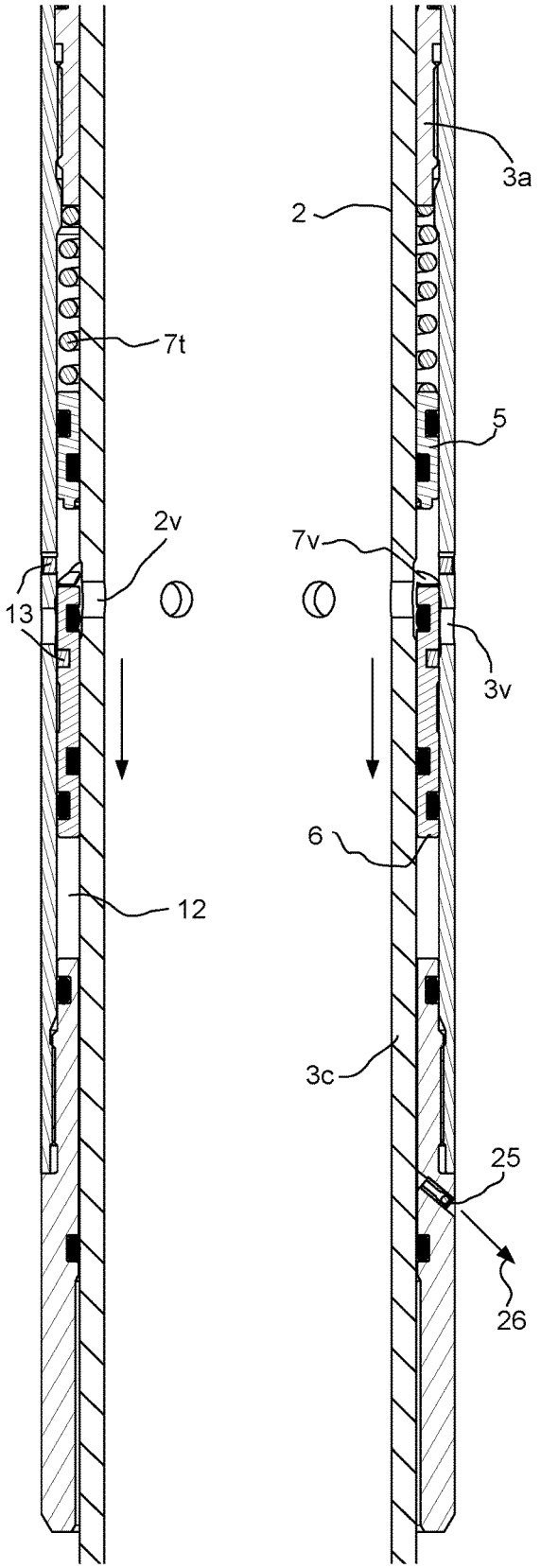
FIG. 3A illustrates the first toe valve in a third intermediate position while shifting from the closed position to the open position.

FIG. 3A illustrates the first toe valve 1 in a third intermediate position while shifting from the closed position to the open position. Release of the valve piston 6 from the housing 3 allows the force exerted by hydrostatic pressure acting on an upper face of the valve piston to push the valve piston longitudinally downward into the atmospheric chamber 12. As the upper one of the inner seals 8 of the valve piston 6 approaches the mandrel valve ports 2*v*, the fluid 14 from the mandrel bore may also exert pressure on the upper face of valve piston 6, thereby assisting with movement thereof into the atmospheric chamber 12. The vent may prevent any wellbore fluid 26 that has leaked into the atmospheric chamber 12 from obstructing movement of the valve piston 6 by allowing the wellbore fluid to be expelled from the atmospheric chamber through the vent port and the open check valve 25 and back into the wellbore (by fracturing the cement sheath).

Figure 3B:
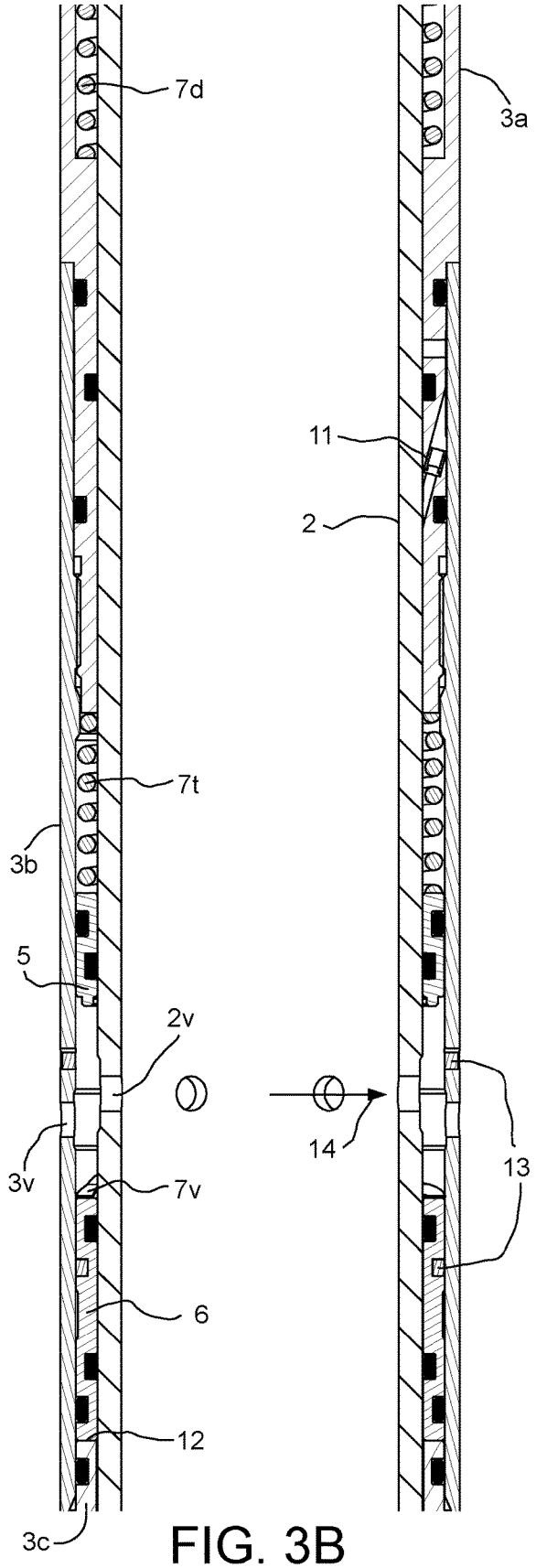
FIG. 3B illustrates the first toe valve in the open position.

FIG. 3B illustrates the first toe valve 1 in the open position. Shifting of the toe valve 1 may be complete when a lower face of the valve piston 6 engages the top of the lower housing section 3*c*, thereby providing fluid communication between the mandrel valve ports 2*v* and the housing valve ports 3*v* via the valve chamber. The mandrel bore fluid 14 may then be pumped into the formation adjacent to the wellbore by fracturing the cement sheath.

Alternatively, the rupture disks 9 and/or the rupture disk 11 may have the set pressure less than or equal to the testing pressure instead of the overpressure or have the set pressure greater than the cementing pressure and less than the testing pressure. Alternatively, the shearable fasteners 13 may be set to withstand the force exerted on the upper face of the valve piston 6 by the trigger piston 5 having the testing pressure exerted thereon. Alternatively, a different type of debris excluder may be used instead of the rupture disks 9, such as filters or an array of micro-ports. Alternatively, the springs 7*d,t,v* and/or the rupture disks 9 may be omitted.

Figure 4A:
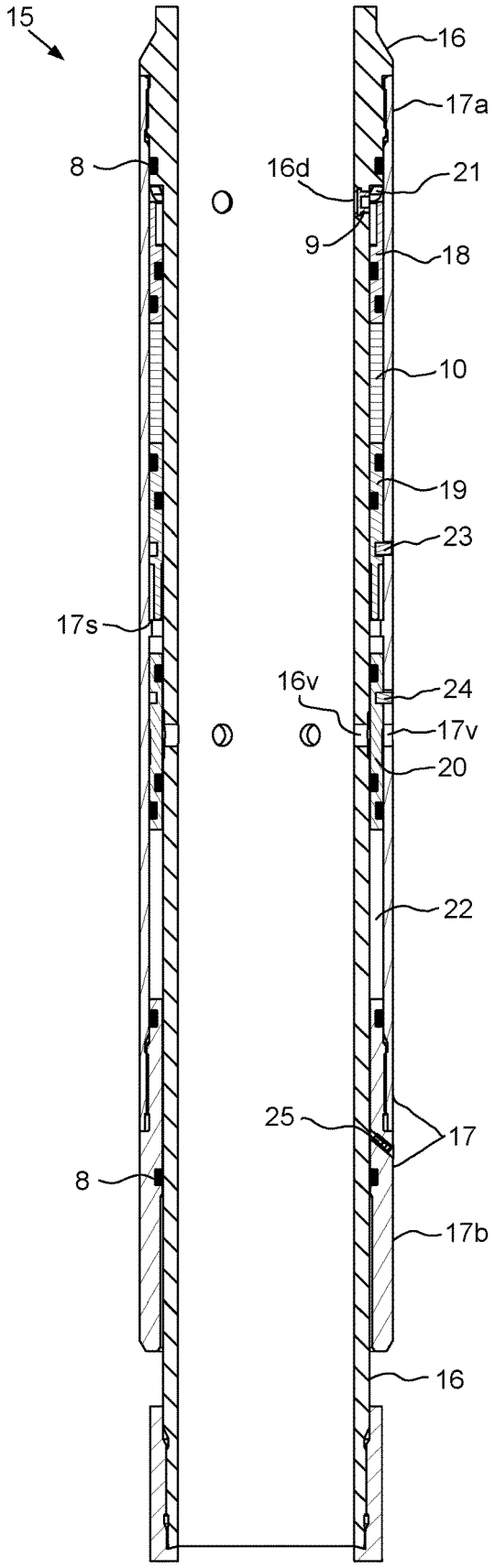
FIG. 4A illustrates a second toe valve with a vented atmospheric chamber in a closed position, according to another embodiment of the present disclosure.

FIG. 4A illustrates a second toe valve 15 with a vented atmospheric chamber 22 in a closed position, according to another embodiment of the present disclosure. The toe valve 15 may include a mandrel 16, a housing 17, a drive piston 18, a trigger piston 19, a valve piston 20, and a drive spring 21. The mandrel 16 may be a tubular member having a longitudinal bore formed therethrough and couplings, such as threads (only lower thread shown), formed at longitudinal ends thereof for assembly of the toe valve 15 as part of a casing string or liner string.

The housing 17 may be a sleeve including a plurality of sections 17*a,b* extending along the mandrel 16. The mandrel 16 may have a boss formed in a periphery thereof and an upper longitudinal end of the upper housing section 17*a* may be mounted thereto, such as by a threaded connection. An interface between the mandrel 16 and the upper housing section 17*a* may be sealed, such as by an elastomeric o-ring 8, carried in a groove formed in the mandrel boss. An annulus may be formed longitudinally between the boss of the mandrel 16 and a top of the lower housing section 17*b* and radially between the upper housing section 17*a* and the periphery of the mandrel.

The drive piston 18, the trigger piston 19, and the valve piston 20 may be disposed in the annulus and may divide the annulus into an upper bore chamber, a mid hydraulic chamber, a mid valve chamber and the lower atmospheric chamber 22. The drive piston 18 may be annular and may carry inner and outer seals, such as elastomeric o-rings 8, in respective inner and outer grooves formed therein. The drive piston 18 may also have an inner recess formed in an upper portion thereof which may facilitate fluid communication with the mandrel bore. The mandrel 16 may have one or more (two shown) drive ports 16*d* formed through a wall thereof adjacent to a top of the annulus to provide fluid communication between the mandrel bore and the upper bore chamber. A debris excluder, such as the rupture disk 9, may be disposed in each upper drive port 16*d* and mounted to the mandrel 16, thereby closing the drive ports and isolating the mandrel bore from the bore chamber. The drive spring 21 may be a compression spring, such as a wave spring, may be disposed in the bore chamber, and may have an upper end bearing against the mandrel boss and a lower end bearing against the drive piston 18, thereby biasing the drive piston away from the mandrel boss.

The hydraulic fluid 10 may be disposed in the hydraulic chamber and may hydraulically link the drive piston 18 and the trigger piston 19. The trigger piston 19 may be annular and may carry inner and outer seals, such as elastomeric o-rings 8, in respective inner and outer grooves formed therein. The trigger piston 19 may also have inner and outer recesses formed in a lower portion to define a stinger which may facilitate interaction with the valve piston 20. The upper housing section 17*a* may have a shoulder 17*s* formed in an inner surface thereof for receiving the trigger piston 19.

Figure 5A:
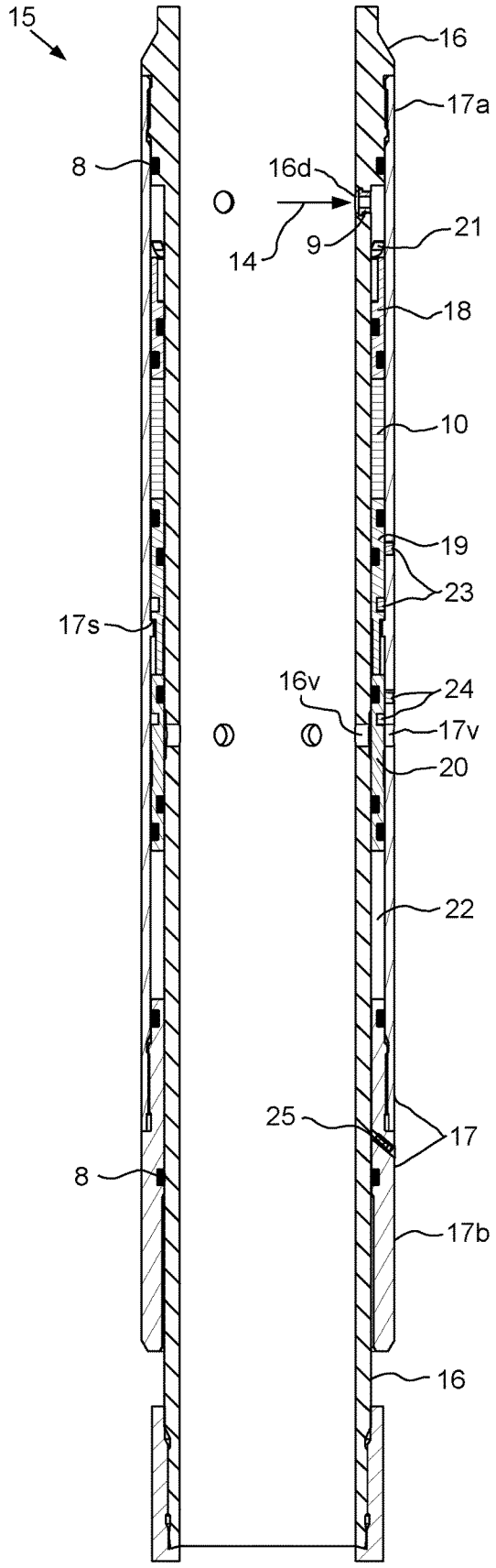
FIG. 5A illustrates the second toe valve in a second intermediate position while shifting from the closed position to the open position.
Figure 5B:
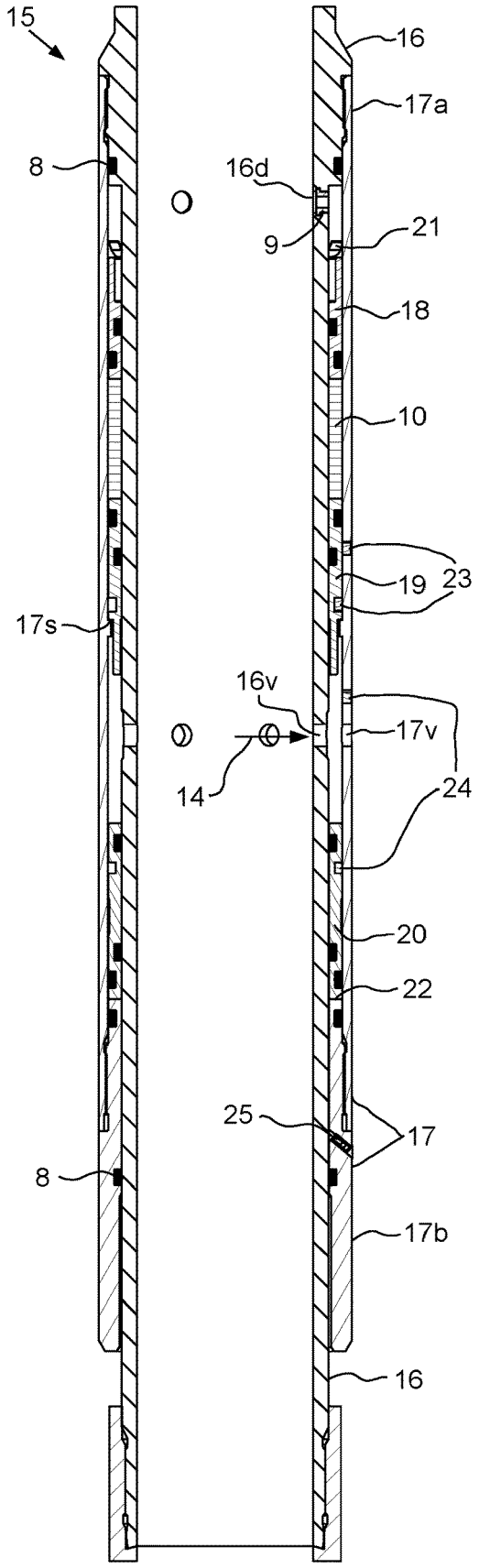
FIG. 5B illustrates the second toe valve in the open position.

The mandrel 16 may have one or more (four shown) valve ports 16*v* formed through a wall thereof adjacent a lower portion of the annulus to provide fluid communication between the mandrel bore and the valve chamber when the toe valve 15 is in the open position (FIG. 5B). The upper housing section 17*a* may have one or more (two shown) valve ports 17*v* formed through a wall thereof adjacent to the mandrel valve ports 16*v* to provide fluid communication between the valve chamber and a cement sheath (not shown) disposed between the toe valve 15 and a periphery of the wellbore when the toe valve is in the open position. The valve chamber may be in fluid communication with the housing valve ports 17*v* via an unsealed portion of the interface between the valve piston 20 and the upper housing section 17*a*.

The trigger piston 19 may be releasably connected to the upper housing section 17*a* by a shearable fastener 23. The shearable fastener 23 may be set to withstand a force exerted on a lower face of the trigger piston 19 by hydrostatic wellbore pressure acting thereon as the toe sleeve 15 is being deployed into the wellbore. The trigger piston 19 may have a groove formed in a periphery thereof for receiving an inner portion of the shearable fastener 23 and the upper housing section 17*a* may have a port formed through the wall thereof for receiving an outer portion of the shearable fastener.

The valve piston 20 may be releasably connected to the upper housing section 17*a* by a shearable fastener 24. The shearable fastener 24 may be set to withstand a force exerted on an upper face of the valve piston 20 by hydrostatic wellbore pressure acting thereon as the toe sleeve 15 is being deployed into the wellbore. The valve piston 20 may have a groove formed in a periphery thereof for receiving an inner portion of the shearable fastener 24 and the upper housing section 17*a* may have a port formed through the wall thereof for receiving an outer portion of the shearable fastener. The shearable fasteners 23, 24 may be accessible from the exterior of the toe valve 15 for adjustment of the set forces thereof while the toe valve is in the oilfield.

The valve piston 20 may be annular and may carry a pair of inner seals and an outer seal, such as elastomeric o-rings 8, in respective inner and outer grooves formed therein. When the valve piston 20 is in the upper kept position, an upper one of the inner seals may be located above the mandrel valve ports 16*v* and a lower one of the inner seals may be located below the mandrel valve ports, thereby isolating the mandrel bore from the valve chamber and the atmospheric chamber 22. When the valve piston 20 is in the upper kept position, the outer seal may be located below the housing valve ports 17*v*, thereby isolating the atmospheric chamber 22 from the wellbore hydrostatic pressure.

The lower housing section 17*b* may have a reduced diameter upper portion, an enlarged diameter lower portion, and an increased thickness mid portion connecting the upper and lower portions. The upper housing section 17*a* may overlap the upper portion of the lower housing section 17*b* and a bottom of the upper housing section may abut the mid portion of the lower housing section. For isolating the atmospheric chamber 22, the upper portion of the lower housing section 17*b* may carry an outer seal and the mid portion of the lower housing section may carry an inner seal, such as the o-rings 8, in respective inner and outer grooves formed therein for the respective interfaces with the upper housing section 17*a* and the mandrel 16.

Should wellbore fluid 26 leak past either of the inner or outer seals of the lower housing section 17*b* and into the atmospheric chamber 22, the lower housing section may be equipped with a vent located between the inner and outer seals of the lower housing section. The vent may include an angled vent port formed through a wall of the lower housing section and a check valve 25 disposed in the angled vent port and mounted to the mid portion of the lower housing section 17*b*. The vent port may be in fluid communication with the atmospheric chamber 22 via an unsealed portion of the interface between the lower housing section 17*b* and the mandrel 16. The check valve 25 may be oriented to prevent flow of wellbore fluid 26 from the wellbore into the atmospheric chamber 22 and allow flow of wellbore fluid from the atmospheric chamber into the wellbore.

Figure 4B:
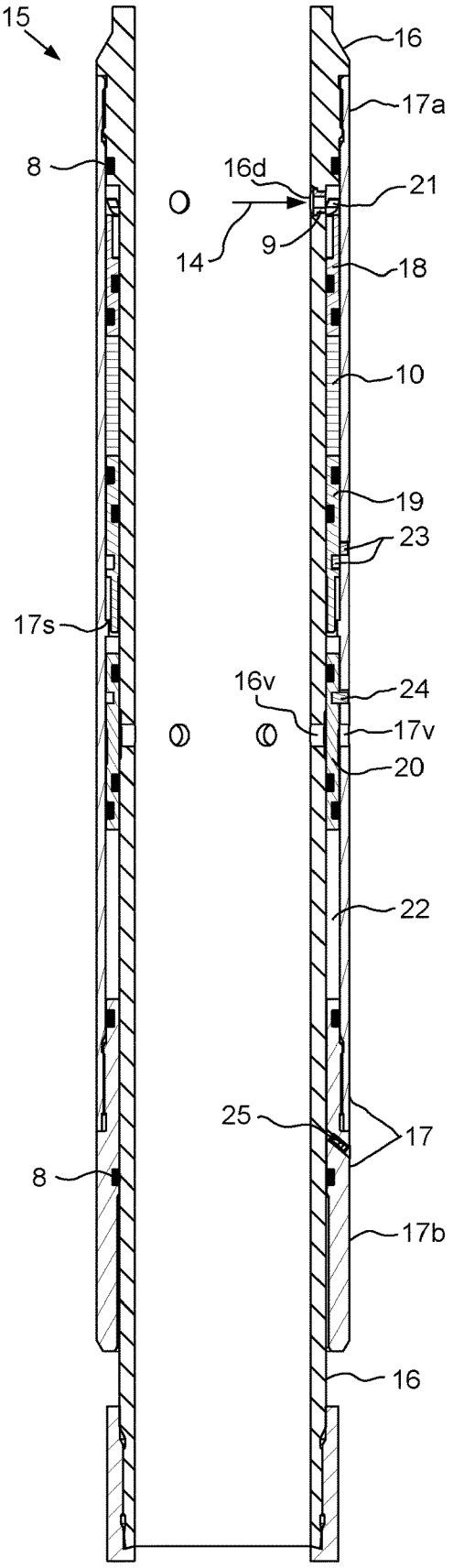
FIG. 4B illustrates the second toe valve in a first intermediate position while shifting from the closed position to an open position.

FIG. 4B illustrates the second toe valve 15 in a first intermediate position while shifting from the closed position to the open position. The second toe valve 15 may be assembled with the casing or liner string, deployed into the wellbore, cemented into place, and pressure tested, as discussed above for the first toe valve 1. Once the pressure test has concluded, the bore of the casing or liner string may be further pressurized to the overpressure. The drive rupture disks 9 may burst, thereby opening the drive ports 16*d* and providing fluid communication between the mandrel bore and the bore chamber. The pressurized bore fluid 14 may enter the bore chamber and exert a fluid force on upper faces of the drive piston 18. The drive piston 18 in turn may pressurize the hydraulic chamber which may exert force on the trigger piston 19 and the associated shearable fastener 23, thereby fracturing the shearable fastener and releasing the trigger piston from the upper housing section 17*a*.

FIG. 5A illustrates the second toe valve 15 in a second intermediate position while shifting from the closed position to the open position. Release of the trigger piston 19 may allow the linked pistons 18, 19 to move longitudinally downward together and the stinger of the trigger piston may engage the valve piston. The trigger piston 19 may exert force on the valve piston 20 and the shearable fastener 24, thereby fracturing the shear pin and releasing the valve piston from the upper housing section 17*a*. The pistons 18-20 may continue the downward longitudinal movement until the trigger piston 19 engages the shoulder 17*s*.

FIG. 5B illustrates the second toe valve 15 in the open position. Release of the valve piston 20 from the housing 17 allows the force exerted by hydrostatic pressure acting on an upper face of the valve piston to push the valve piston longitudinally downward into the atmospheric chamber 22. As the upper one of the inner seals 8 of the valve piston 20 approaches the mandrel valve ports 16*v*, the fluid 14 from the mandrel bore may also exert pressure on the upper face of valve piston 20, thereby assisting with movement thereof into the atmospheric chamber 22. The vent may prevent any wellbore fluid 26 that has leaked into the atmospheric chamber 22 from obstructing movement of the valve piston 20 by allowing the wellbore fluid to be expelled from the atmospheric chamber through the vent port and the open check valve 25 and back into the wellbore (by fracturing the cement sheath).

Shifting of the toe valve 15 may be complete when a lower face of the valve piston 20 engages the top of the lower housing section 17*b*, thereby providing fluid communication between the mandrel valve ports 16*v* and the housing valve ports 17*v* via the valve chamber. The mandrel bore fluid 14 may then be pumped into the formation adjacent to the wellbore by fracturing the cement sheath.

Alternatively, the rupture disks 9 may have the set pressure less than or equal to the testing pressure instead of the overpressure or have the set pressure greater than the cementing pressure and less than the testing pressure. Alternatively, the shearable fastener 23 and/or the shearable fastener 24 may be set to withstand having the testing pressure exerted thereon. Alternatively, a different type of debris excluder may be used instead of the rupture disks 9, such as filters and/or an array of micro-ports. Alternatively, the rupture disks 9 may be omitted.

Figure 6A:
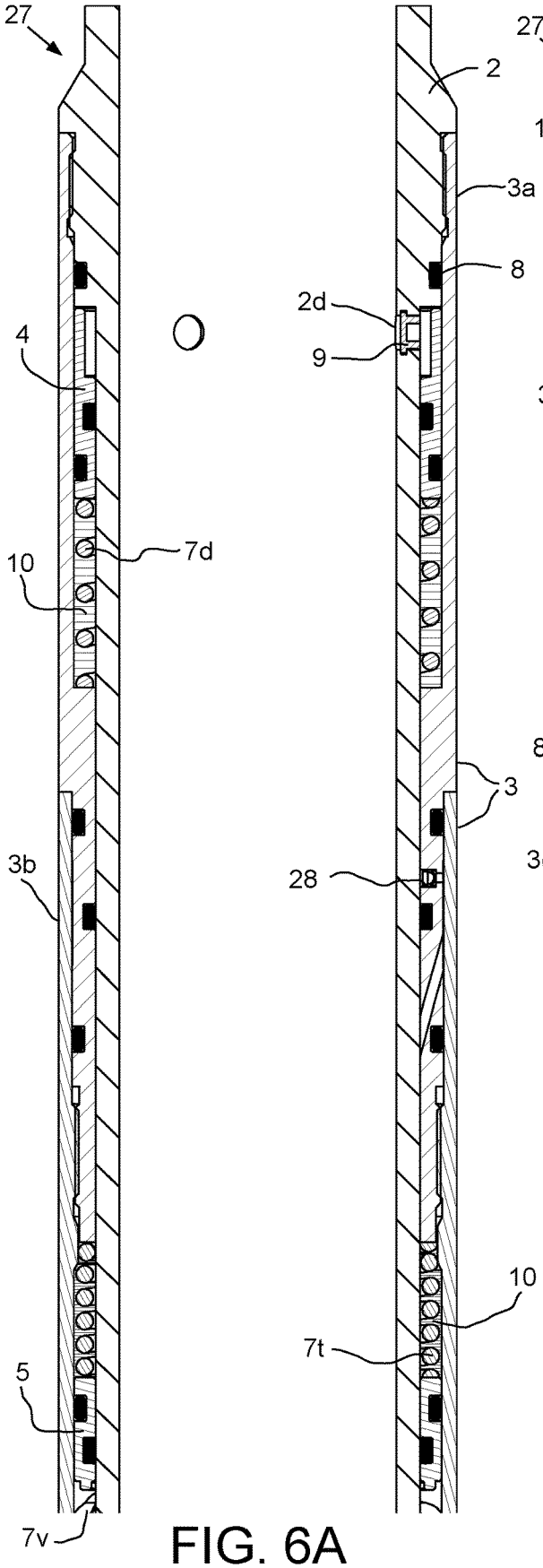
FIGS. 6A and 6B illustrate a third toe valve with a vented atmospheric chamber in a closed position, according to another embodiment of the present disclosure.
Figure 6B:
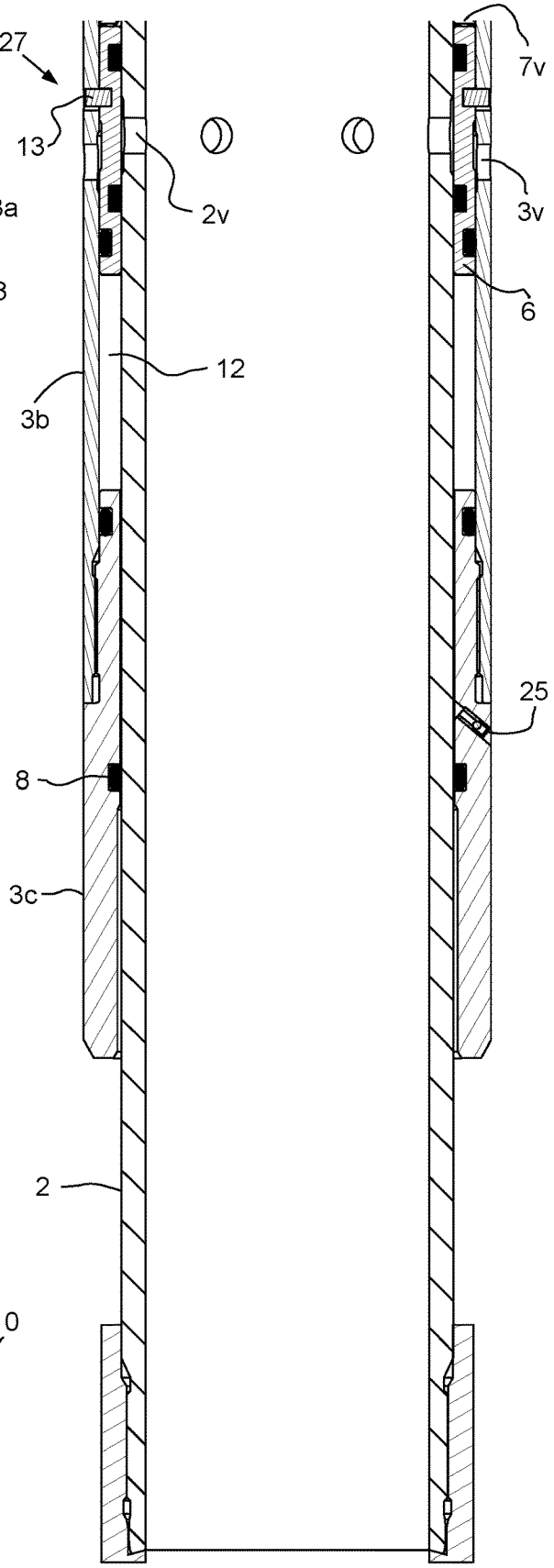

FIGS. 6A and 6B illustrate a third toe valve 27 with the vented atmospheric chamber 12 in a closed position, according to another embodiment of the present disclosure. The third toe valve 27 may be similar or identical to the first toe valve 1 except for having the hydraulic pressure control device, such as the hydraulic rupture disk 28, disposed in the radial hydraulic port instead of the angled hydraulic port, thereby closing the radial hydraulic port and isolating the hydraulic drive chamber from the hydraulic trigger chamber. The hydraulic rupture disk 28 may be mounted to the lower portion of the upper housing section 3*a*.

Alternatively, the rupture disks 9 and/or the rupture disk 28 may have the set pressure less than or equal to the testing pressure instead of the overpressure or have the set pressure greater than the cementing pressure and less than the testing pressure. Alternatively, the shearable fasteners 13 may be set to withstand the force exerted on the upper face of the valve piston 6 by the trigger piston 5 having the testing pressure exerted thereon. Alternatively, a different type of debris excluder may be used instead of the rupture disks 9, such as filters or an array of micro-ports. Alternatively, the springs 7*d,t,v* and/or the rupture disks 9 may be omitted.

Figure 7A:
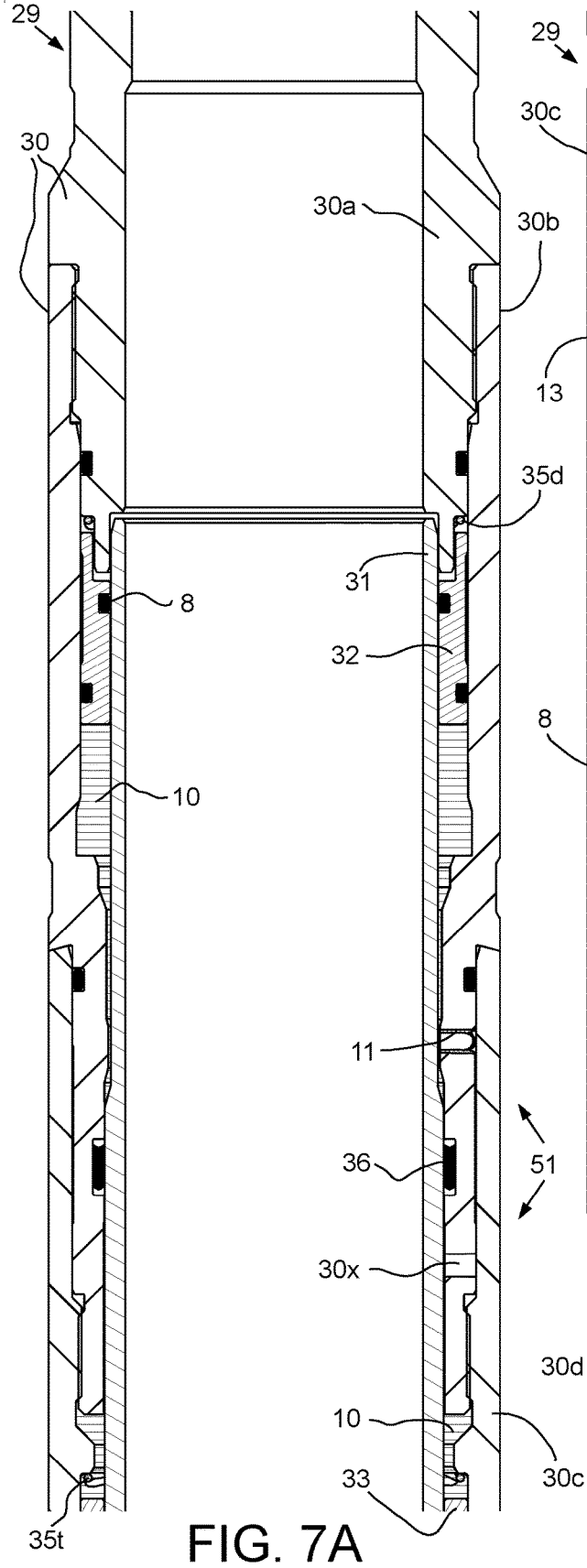
FIGS. 7A and 7B illustrate a fourth toe valve with a vented atmospheric chamber in a closed position, according to another embodiment of the present disclosure.
Figure 7B:
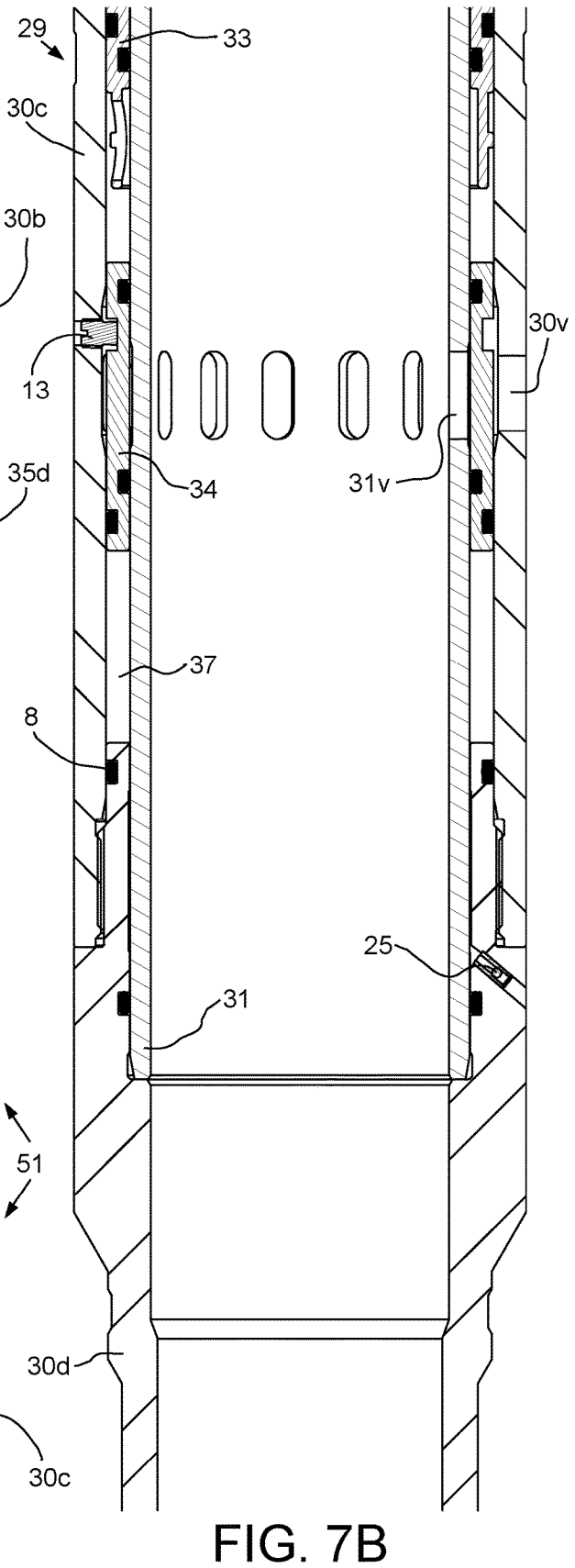

FIGS. 7A and 7B illustrate a fourth toe valve 29 with a vented atmospheric chamber in a closed position, according to another embodiment of the present disclosure. The toe valve 29 may include a housing 30, a mandrel 31, a drive piston 32, a trigger piston 33, a valve piston 34. The housing 30 may be a tubular member having a longitudinal bore formed therethrough and couplings, such as threads (not shown), formed at longitudinal ends thereof for assembly of the toe valve 29 as part of a casing string or liner string. The housing 30 may include a plurality of sections 30*a-d*.

The mandrel 31 may be a sleeve disposed in the bore of the housing 30 and may be longitudinally coupled to the housing by entrapment between an upper shoulder formed in the upper housing section 30*a* and a lower shoulder formed in the lower housing section 30*d*. Inner and outer surfaces of the lower longitudinal end of the upper housing section 30*a* may be recessed, thereby forming a stub at the lower end of the upper housing section. Inner and outer surfaces of the upper longitudinal end of the lower housing section 30*d* may be recessed, thereby forming a stub at the upper end of the lower housing section. An upper longitudinal end of the mandrel 31 may overlap with the stub of the upper housing section 30*a* and a lower longitudinal end of the mandrel may overlap with the stub of the lower housing section 30*d*, thereby transversely coupling the mandrel and the housing. A gap may be formed between the upper longitudinal end of the mandrel 31 and the shoulder of the upper housing section 30*a* to serve as a port and a clearance fit, such as a sliding fit, may be formed between the upper housing section and the mandrel and the interface between the two members may be unsealed to serve as a leak path while discouraging the entry of debris.

The upper housing section 30*a* may have a boss formed in a periphery thereof and an upper longitudinal end of the first mid housing section 30*b* may be mounted thereto, such as by a threaded connection. An interface between the first mid housing section 30*b* and the upper housing section 30*a* may be sealed, such as by an elastomeric o-ring 8, carried in a groove formed in the outer surface of the upper housing section 30*a*. The first mid housing section 30*b* may have an enlarged diameter upper portion, a reduced diameter lower portion, and an increased thickness mid portion connecting the upper and lower portions. An upper annulus may be formed longitudinally between the lower end of the upper housing section 30*a* and the mid portion of the first mid housing section 30*b* and radially between the first mid housing section and a periphery of the mandrel 31.

The drive piston 32 may be disposed in the upper annulus and may divide the upper annulus into an upper bore chamber and a lower hydraulic drive chamber. The drive piston 32 may be annular and may carry inner and outer seals, such as elastomeric o-rings 8, in respective inner and outer grooves formed therein. The drive piston 32 may also have an inner recess formed in an upper portion thereof which may form a stud at an upper end thereof and which may receive the stub of the upper housing section 30*a*. A clearance fit, such as a sliding fit, may be formed between the stubs of the upper housing section 30*a* and the drive piston 32. A drive spring 35*d* may be a compression spring, such as a wave spring, may be disposed in the upper bore chamber, and may have an upper end bearing against a spring shoulder formed in the upper housing section 30*a* and a lower end bearing against the stub of the drive piston 32 thereby biasing the drive piston away from the upper housing section.

Hydraulic fluid 10, such as refined and/or synthetic oil, may be disposed in the hydraulic drive chamber. For simplicity, the hydraulic fluid 10 is shown in FIG. 7A and depicted in FIGS. 8 and 9 with arrows, though it remains in the hydraulic chambers throughout shifting of the fourth toe sleeve 29. The second mid housing section 30*c* may overlap the lower portion of the first mid housing section 30*b* and a top of the second mid housing section may abut the mid portion of the first mid housing section.

The lower portion of the first mid housing section 30*b* may include a hydraulic activator 51 having a hydraulic control port formed through a wall thereof and a hydraulic crossover port 30*x* formed through the wall thereof. A hydraulic pressure control device, such as a rupture disk 11, may be disposed in the hydraulic control port and may be mounted to the lower portion of the first mid housing section 30*b*, thereby closing the hydraulic control port and isolating the hydraulic drive chamber from a hydraulic trigger chamber. The hydraulic rupture disk 11 may have a set pressure greater than the cementing pressure and the testing pressure. The hydraulic control port may be in fluid communication with the hydraulic drive chamber via an unsealed portion of the interface between the first mid housing section 30*b* and the mandrel 31. The hydraulic crossover port 30*x* may be in fluid communication with the hydraulic control port via an unsealed portion of the interface between the first and second mid housing sections 30*b,c*. The hydraulic crossover port 30*x* may be in fluid communication with the hydraulic trigger chamber via another unsealed portion of the interface between the first mid housing section 30*a* and the mandrel 31.

For isolating the hydraulic activator 51 from leakage or bypass, the lower portion of the first mid housing section 30*b* may carry an inner seal, such as a stack 36 of chevron-shaped elastomeric seal rings, and an outer seal, such as an elastomeric o-ring 8, in respective inner and outer grooves formed therein for the respective interfaces with the mandrel 31 and the second mid housing section 30*c*. The outer seal may be located above the hydraulic control port. The inner seal may be located between the control and crossover 30*x* hydraulic ports. The second mid housing section 30*c* may be mounted to a lower longitudinal end of the first mid housing section 30*b*, such as by a threaded connection.

A lower annulus may be formed longitudinally between the bottom of the first mid housing section 30*b* and a top of the lower housing section 30*d* and radially between the second mid housing section 30*c* and the periphery of the mandrel 31. The trigger piston 33 and the valve piston 34 may be disposed in the lower annulus and may divide the lower annulus into the upper hydraulic trigger chamber, a mid valve chamber, and a lower atmospheric chamber 37. The trigger piston 33 may be annular and may carry inner and outer seals, such as elastomeric o-rings 8, in respective inner and outer grooves formed therein. The trigger piston 33 may also have inner and outer recesses formed in a lower portion to define a stinger which may facilitate interaction with the valve piston 34. The hydraulic fluid 10 may be disposed in the hydraulic trigger chamber. A trigger spring 35*t* may be a compression spring, such as a wave spring, may also be disposed in the hydraulic trigger chamber, and may have an upper end bearing against a boss formed in an inner surface of the second mid housing section 30*c* and a lower end bearing against the trigger piston 33, thereby biasing the trigger piston toward the valve piston 34.

Figure 9A:
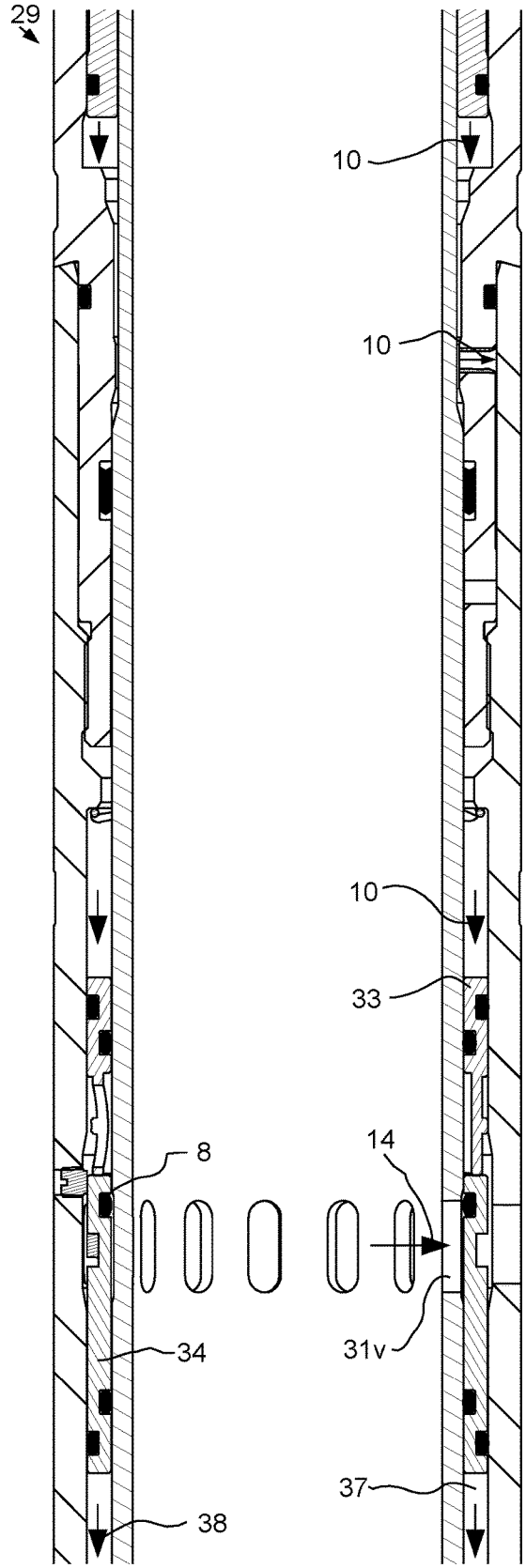
FIG. 9A illustrates the fourth toe valve in a third intermediate position while shifting from the closed position to the open position.
Figure 9B:
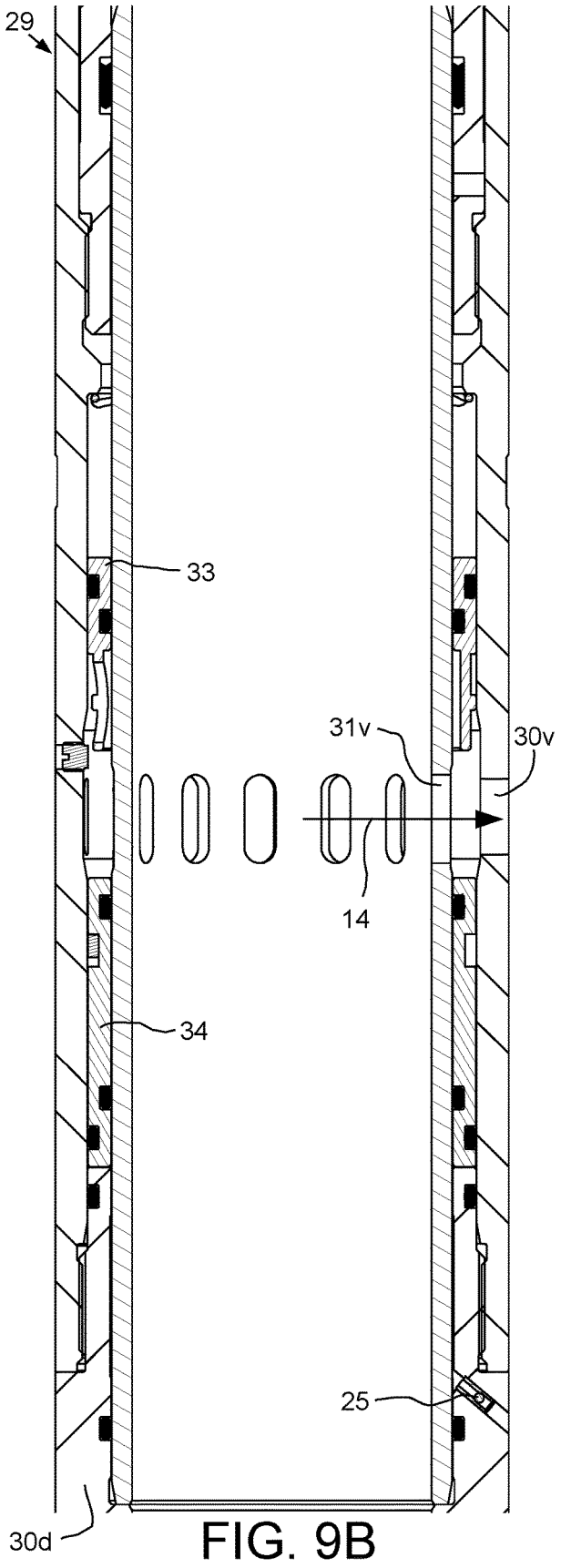
FIG. 9B illustrates the fourth toe valve in the open position.

The mandrel 31 may have one or more (six shown) valve ports 31*v* formed through a wall thereof adjacent to a mid-point of the lower annulus to provide fluid communication between the mandrel bore and the valve chamber when the toe valve 29 is in the open position (FIG. 9B). The second mid housing section 30*c* may have one or more (one shown and one partially shown) valve ports 30*v* formed through a wall thereof adjacent to the mandrel valve ports 31*v* to provide fluid communication between the valve chamber and a cement sheath (not shown) disposed between the toe valve 29 and a periphery of the wellbore when the toe valve is in the open position.

The valve chamber may be in fluid communication with the housing valve ports 30*v* via an unsealed portion of the interface between the valve piston 34 and the second mid housing section 30*c*. The valve piston 34 may be releasably connected to the second mid housing section 30*c* by one or more (one shown) shearable fasteners 13. Collectively, the shearable fasteners 13 may be set to withstand a force exerted on an upper face of the valve piston 34 by hydrostatic wellbore pressure acting thereon as the toe sleeve 29 is being deployed into the wellbore. The valve piston 34 may have a groove formed in a periphery thereof for receiving inner portions of the shearable fasteners 13 and the second mid housing section 30*c* may have a port formed through the wall thereof for each shearable fastener for receiving an outer portion thereof. The shearable fasteners 13 may be accessible from the exterior of the toe valve 29 for adjustment of the set force thereof while the toe valve is in the oilfield.

The valve piston 34 may be annular and may carry a pair of inner seals and an outer seal, such as elastomeric o-rings 8, in respective inner and outer grooves formed therein. When the valve piston 34 is in the upper kept position, an upper one of the inner seals may be located above the mandrel valve ports 31*v* and a lower one of the inner seals may be located below the mandrel valve ports, thereby isolating the mandrel bore from the valve chamber and the atmospheric chamber 37. When the valve piston 34 is in the upper kept position, the outer seal may be located below the housing valve ports 30*v*, thereby isolating the atmospheric chamber 37 from the wellbore hydrostatic pressure.

The lower housing section 30*d* may have an enlarged diameter upper portion, a reduced diameter lower portion, and an increased thickness mid portion connecting the upper and lower portions. The second mid housing section 30*c* may overlap the upper portion of the lower housing section 30*d* and a bottom of the second mid housing section may abut the mid portion of the lower housing section. For isolating the atmospheric chamber 37, the upper portion of the lower housing section 30*d* may carry an outer seal and the mid portion of the lower housing section may carry an inner seal, such as elastomeric o-rings 8, in respective inner and outer grooves formed therein for the respective interfaces with the second mid housing section 30*c* and the mandrel 31.

Should wellbore fluid 26 (FIG. 3A) leak past either of the inner or outer seals of the lower housing section 30*d* and into the atmospheric chamber 37, the lower housing section may be equipped with a vent located between the inner and outer seals of the lower housing section. The vent may include an angled vent port formed through a wall of the lower housing section and a check valve 25 disposed in the angled vent port and mounted to the mid portion of the lower housing section 30*d*. The vent port may be in fluid communication with the atmospheric chamber 37 via an unsealed portion of the interface between the lower housing section 30*d* and the mandrel 31. The check valve 25 may be oriented to prevent flow of wellbore fluid 26 from the wellbore into the atmospheric chamber 37 and allow flow of wellbore fluid from the atmospheric chamber into the wellbore.

Figure 8A:
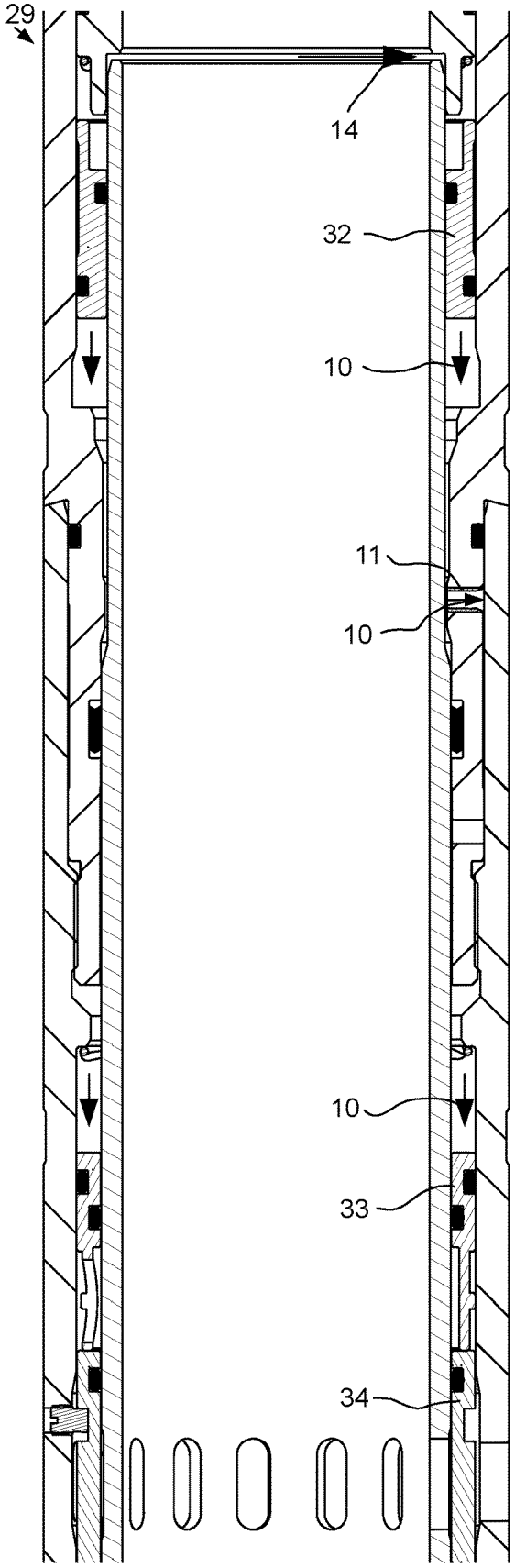
FIG. 8A illustrates the fourth toe valve in a first intermediate position while shifting from the closed position to an open position.

FIG. 8A illustrates the fourth toe valve 29 in a first intermediate position while shifting from the closed position to an open position. The toe valve 29 may be assembled as part of a casing string or a liner string and usually located in proximity to a lower end of the string. Once assembled, the casing or liner string is then deployed into the wellbore adjacent to an oil or gas bearing formation. The casing or liner string may then be cemented into position in the wellbore by pumping cement slurry down a bore thereof and up an annulus formed between the casing or liner string and the wellbore. Once the cement slurry has cured into a cement sheath in the wellbore annulus, a pressure test may be performed by pressurizing the bore of the casing or liner string to the testing pressure and holding the testing pressure for a period of time, such as between five minutes and one hour. The toe valve 29 may remain in the closed position during assembly with the casing or liner string, deployment into the wellbore, cementing of the casing or liner string, and pressure testing.

Once the pressure test has concluded, the bore of the casing or liner string may be further pressurized to an overpressure. The overpressure may be greater than the testing pressure which may be greater than the cementing pressure. The overpressure may exceed the testing pressure by an amount ranging between one-hundred five percent and one-hundred twenty-five percent. The overpressure may be equal to or greater than the set pressure of the rupture disk 11. The overpressure may be held until the toe valve 29 shifts from the closed position to the open position.

Pressurized bore fluid 14 may enter the bore chamber and exert a fluid force on upper faces of the drive piston 32. The drive piston 32 in turn may pressurize the hydraulic drive chamber until the hydraulic rupture disk 11 bursts, thereby opening the hydraulic control port and hydraulically linking the drive piston 32 and the trigger piston 33. The pressurized bore fluid 14 and pressurized hydraulic fluid 10 may move the linked pistons 32, 33 longitudinally downward together and the stinger of the trigger piston 33 may engage the valve piston 34.

Figure 8B:
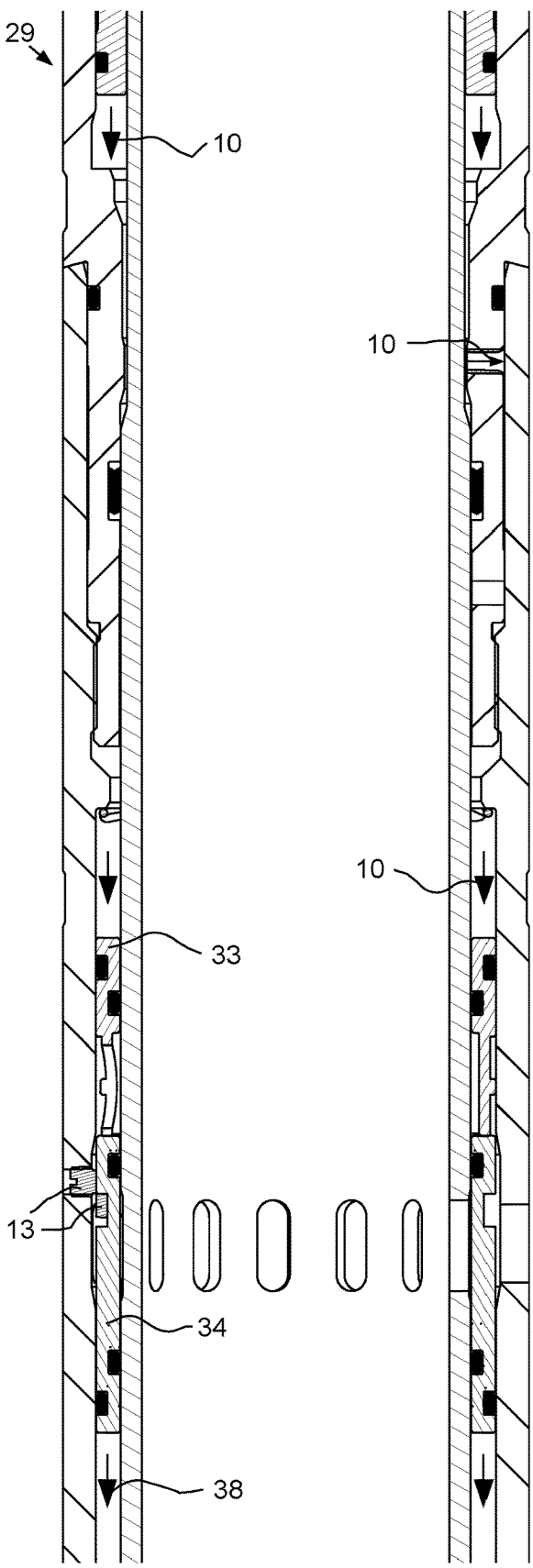
FIG. 8B illustrates the fourth toe valve in a second intermediate position while shifting from the closed position to the open position.

FIG. 8B illustrates the fourth toe valve 29 in a second intermediate position while shifting from the closed position to the open position. The stinger of the trigger piston 33 may exert force on the valve piston 34 and the shearable fasteners 13, thereby fracturing the shearable fasteners and releasing the valve piston from the second mid housing section 30*c*.

FIG. 9A illustrates the fourth toe valve 29 in a third intermediate position while shifting from the closed position to the open position. Release of the valve piston 34 from the housing 30 allows the trigger piston 33 to push the valve piston longitudinally downward 38 into the atmospheric chamber 37. As the upper one of the inner seals 8 of the valve piston 34 approaches the mandrel valve ports 31*v*, the fluid 14 from the mandrel bore may also exert pressure on the upper face of valve piston 34, thereby assisting with movement 38 thereof into the atmospheric chamber 37. The vent may prevent any wellbore fluid 26 that has leaked into the atmospheric chamber 37 from obstructing movement of the valve piston 34 by allowing the wellbore fluid to be expelled from the atmospheric chamber through the vent port and the open check valve 25 and back into the wellbore (by fracturing the cement sheath).

FIG. 9B illustrates the fourth toe valve 29 in the open position. Shifting of the toe valve 29 may be complete when a lower face of the valve piston 34 engages the top of the lower housing section 30*d*, thereby providing fluid communication between the mandrel valve ports 31*v* and the housing valve ports 30*v* via the valve chamber. The mandrel bore fluid 14 may then be pumped into the formation adjacent to the wellbore by fracturing the cement sheath. Entrance of the mandrel bore fluid 14 into the valve chamber should halt downward movement of the trigger piston 33 before the stinger of the trigger piston moves between the mandrel valve ports 31*v* and the housing valve ports 30*v*. Should this movement of the trigger piston 33 not be halted, the stinger of the trigger piston may have one or more (one shown) ports formed therethrough so that the stinger will not significantly obstruct flow through the open toe valve 29.

Figure 10A:
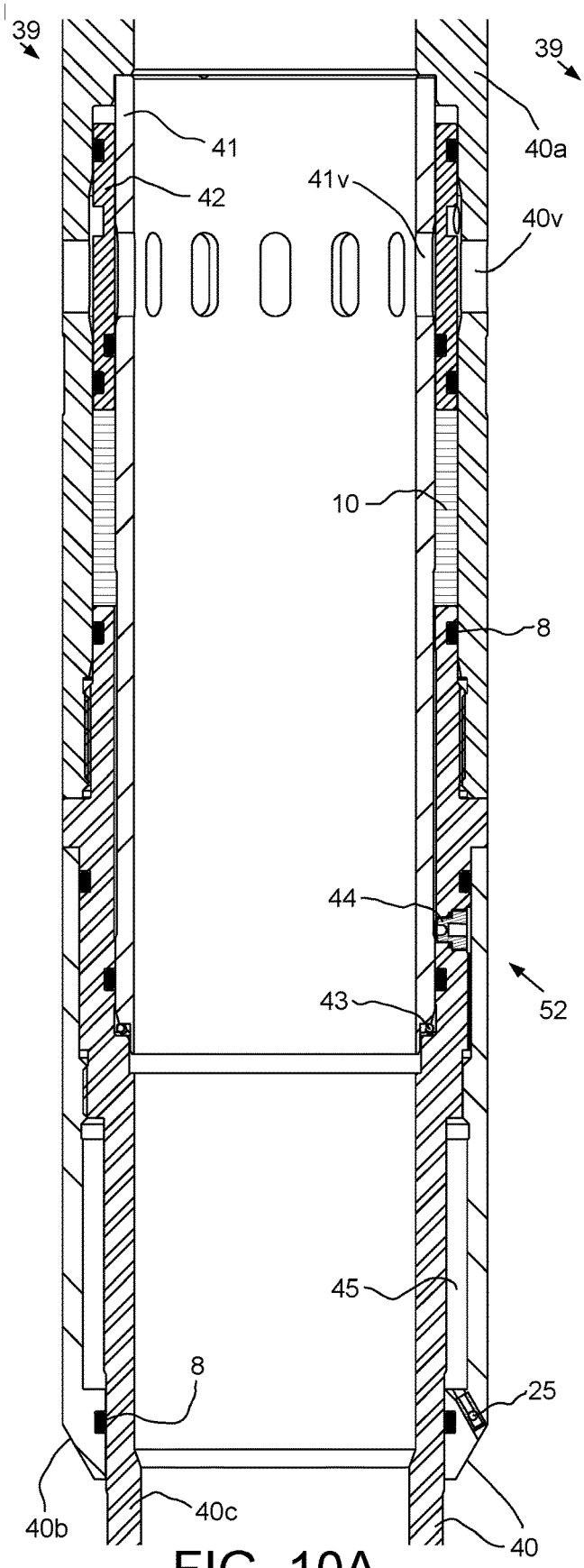
FIG. 10A illustrates a fifth toe valve with a vented atmospheric chamber in a closed position, according to another embodiment of the present disclosure.

FIG. 10A illustrates a fifth toe valve 39 with a vented atmospheric chamber in a closed position, according to another embodiment of the present disclosure. The toe valve 39 may include a housing 40, a mandrel 41, and a valve piston 42. The housing 40 may be a tubular member having a longitudinal bore formed therethrough and couplings, such as threads (not shown), formed at longitudinal ends thereof for assembly of the toe valve 39 as part of a casing string or liner string. The housing 40 may include a plurality of sections 40*a-c*.

The upper housing section 40*a* may have a boss formed in an inner surface thereof. The mandrel 41 may be a sleeve disposed in the bore of the housing 40 and may be longitudinally coupled to the housing by entrapment between an inner shoulder formed in the boss of the upper housing section 40*a* and a shoulder formed in the inner housing section 40*c*. A recess may be formed in an outer surface of the mandrel adjacent a lower longitudinal end thereof, thereby forming a shoulder and stub thereat. A receptacle may be formed in an inner surface of the inner housing section 40*c* adjacent to the shoulder thereof. A spring chamber may be formed longitudinally between the shoulder of the mandrel 41 and the shoulder of the inner housing section 40*c* and radially between the inner surface of the inner housing section and an outer surface of the stub of the mandrel. A spring 43 may be a compression spring, such as a wave spring, and may be disposed in the spring chamber, and may have an upper end bearing against the shoulder of the mandrel 41 and a lower end bearing against the shoulder of the inner housing section 40*c*, thereby biasing a top of the mandrel into engagement with the shoulder of the upper housing section 40*a*.

One or more notches (two shown) may be formed in the top of the mandrel 41 to serve as a port. A receptacle may be formed in the boss of the upper housing section 40*a* adjacent to the inner shoulder thereof and a clearance fit, such as a sliding fit, may be formed between the receptacle and the mandrel 41 and the interface between the two members may be unsealed to serve as a leak path while discouraging the entry of debris.

An upper annulus may be formed longitudinally between an outer shoulder of the boss of the upper housing section 40*a* and a top of the mid housing section 40*b* and radially between the upper housing section and a periphery of the mandrel 41. The valve piston 42 may be disposed in the upper annulus and may divide the upper annulus into the upper bore chamber and a lower hydraulic chamber. Hydraulic fluid 10, such as refined and/or synthetic oil, may be disposed in the hydraulic chamber.

Figure 11A:
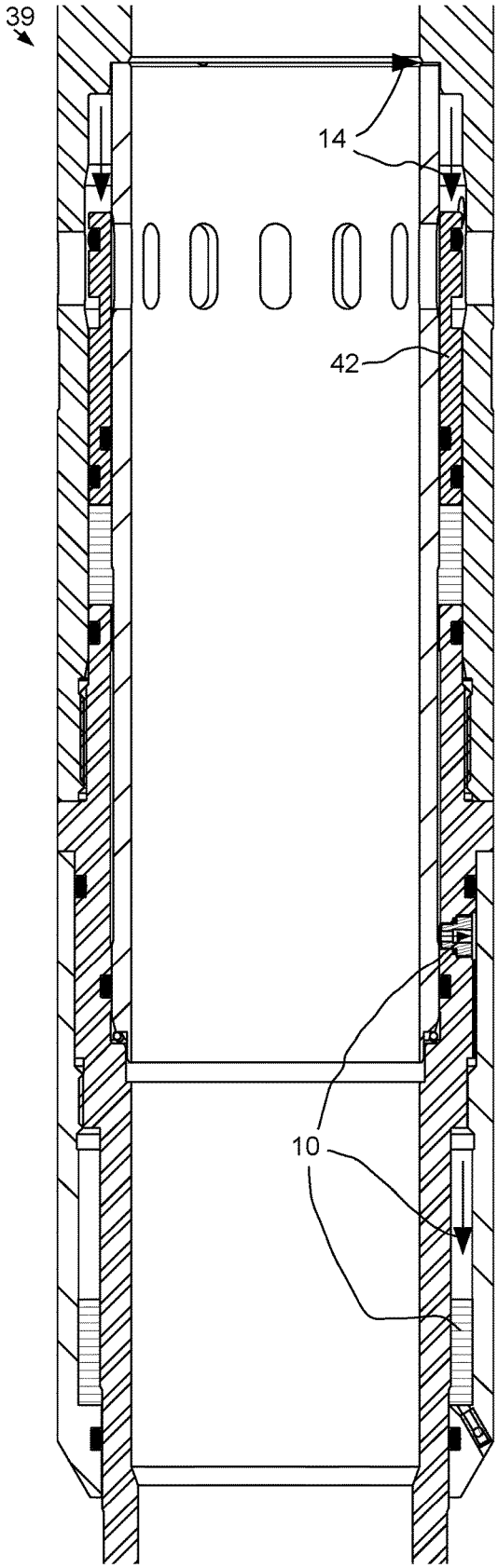
FIG. 11A illustrates the fifth toe valve in a second intermediate position while shifting from the closed position to the open position.
Figure 11B:
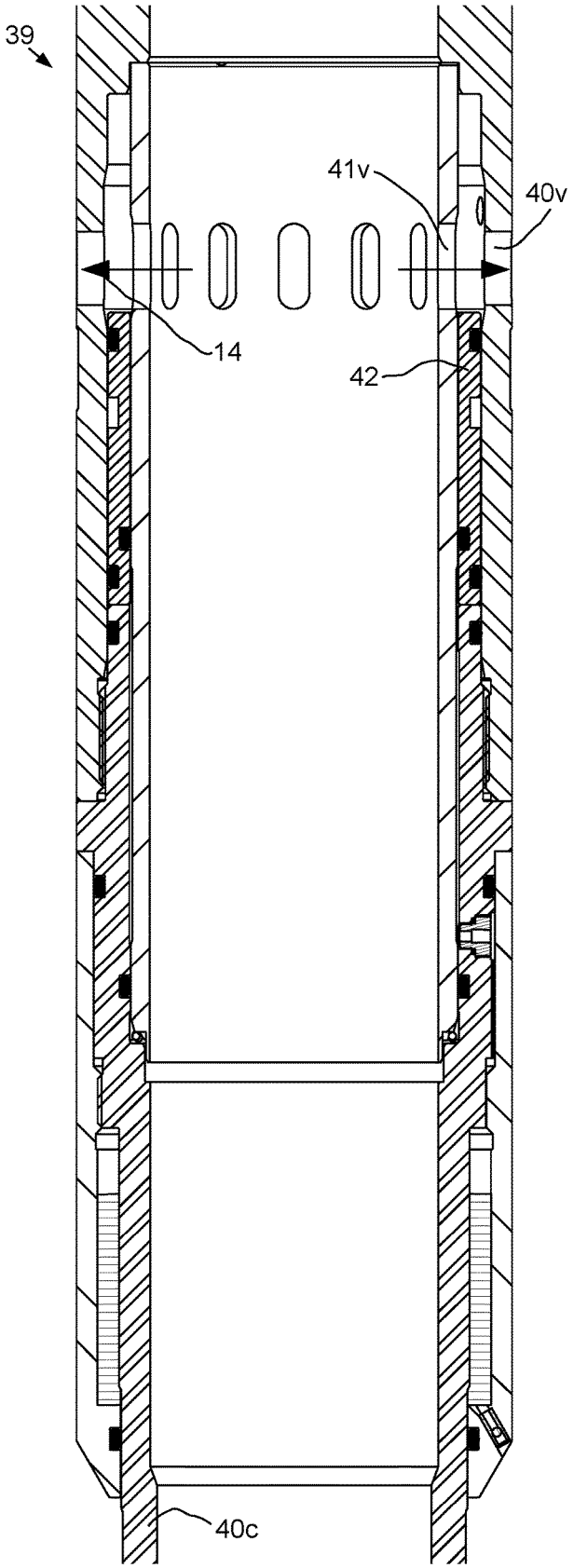
FIG. 11B illustrates the fifth toe valve in the open position.

The mandrel 41 may have one or more (seven shown) valve ports 41*v* formed through a wall thereof adjacent to the upper annulus to provide fluid communication between the mandrel bore and the valve chamber when the toe valve 39 is in the open position (FIG. 11B). The upper housing section 40*a* may have one or more (two shown) valve ports 40*v* formed through a wall thereof adjacent to the mandrel valve ports 41*v* to provide fluid communication between the valve chamber and a cement sheath (not shown) disposed between the toe valve 39 and a periphery of the wellbore when the toe valve is in the open position.

The valve piston 42 may have a groove formed in a periphery thereof for receiving a locator pin (not shown)

used for assembly of the toe valve 39 and the upper housing section 40*a* may have a hole formed through the wall thereof for receiving an outer portion of the locator pin. The valve piston 42 may be annular and may carry a pair of outer seals and an inner seal, such as elastomeric o-rings 8, in respective outer and inner grooves formed therein. When the valve piston 42 is in the upper kept position, an upper one of the outer seals may be located above the housing valve ports 40*v* and a lower one of the outer seals may be located below the housing valve ports, thereby isolating the bore chamber and the hydraulic chamber from wellbore hydrostatic pressure. When the valve piston 34 is in the upper kept position, the inner seal may be located below the mandrel valve ports 41*v*, thereby isolating the hydraulic chamber from the mandrel bore.

An upper longitudinal end of the inner housing section 40*c* may be mounted to a lower longitudinal end of the upper housing section 40*a*, such as by a threaded connection. An interface between the inner housing section 40*c* and the upper housing section 40*a* may be sealed, such as by an elastomeric o-ring 8, carried in a groove formed in the outer surface of the inner housing section 40*c*. The inner housing section 40*c* may have an enlarged diameter upper portion, a reduced diameter lower portion, and an increased thickness mid portion connecting the upper and lower portions.

The upper portion of the inner housing section 40*c* may include a hydraulic activator 52 having a hydraulic port formed through a wall thereof. A hydraulic pressure control device, such as a rupture disk 44, may be disposed in the hydraulic control port and may be mounted to the upper portion of the inner housing section 40*c*, thereby closing the hydraulic control port and isolating the hydraulic chamber from an atmospheric chamber 45. The hydraulic rupture disk 44 may have a set pressure greater than the cementing pressure and the testing pressure. The hydraulic control port may be in fluid communication with the hydraulic chamber via an unsealed portion of the interface between the inner housing section 40*c* and the mandrel 41. The hydraulic control port may be in fluid communication with the atmospheric chamber 45 via an unsealed portion of the interface between the outer and inner housing sections 40*b,c*.

For isolating the hydraulic activator 52 from leakage or bypass, the upper portion of the inner housing section 40*c* may carry an inner seal and an outer seal, such as elastomeric o-rings 8, in respective inner and outer grooves formed therein for the respective interfaces with the mandrel 41 and the outer housing section 40*b*. The outer seal may be located above the hydraulic control port. The inner seal may be located below the hydraulic control port. The outer housing section 40*b* may be mounted the mid portion of the inner housing section 40*c*, such as by a threaded connection. The thread of the inner housing section 40*c* connecting to the outer housing section 40*b* may have a slot formed therethrough in alignment with the control port to facilitate fluid communication with the atmospheric chamber 45.

The atmospheric chamber 45 may be a lower annulus formed longitudinally between a shoulder of the inner housing section 40*c* and a shoulder of the outer housing section 40*b* and radially between the outer and inner housing sections 40*b,c*. The inner housing section 40*b* may have recessed upper and mid portions and a tapered diameter lower portion. The outer housing section 40*b* may overlap the upper portion of the inner housing section 40*c* and a top of the outer housing section may abut a boss formed in the outer surface of the inner housing section 40*c*. For isolating the atmospheric chamber 45, the lower portion of the outer housing section 40*b* may carry a seal, such as an elastomeric o-ring 8, in an inner groove formed therein for the interface with the inner housing section 40*c*.

Should wellbore fluid 26 (FIG. 3A) leak past the seal of the outer housing section 40*b* and into the atmospheric chamber 45, the outer housing section may be equipped with a vent located between adjacent the shoulder thereof. The vent may include an angled vent port formed through a wall of the outer housing section 40*b* and a check valve 25 disposed in the angled vent port and mounted to the lower portion of the outer housing section. The vent port may be in fluid communication with the atmospheric chamber 45. The check valve 25 may be oriented to prevent flow of wellbore fluid 26 from the wellbore into the atmospheric chamber 45 and allow flow of wellbore fluid from the atmospheric chamber into the wellbore.

Alternatively, the vent and check valve 25 may be omitted from the toe valve 39.

Figure 10B:
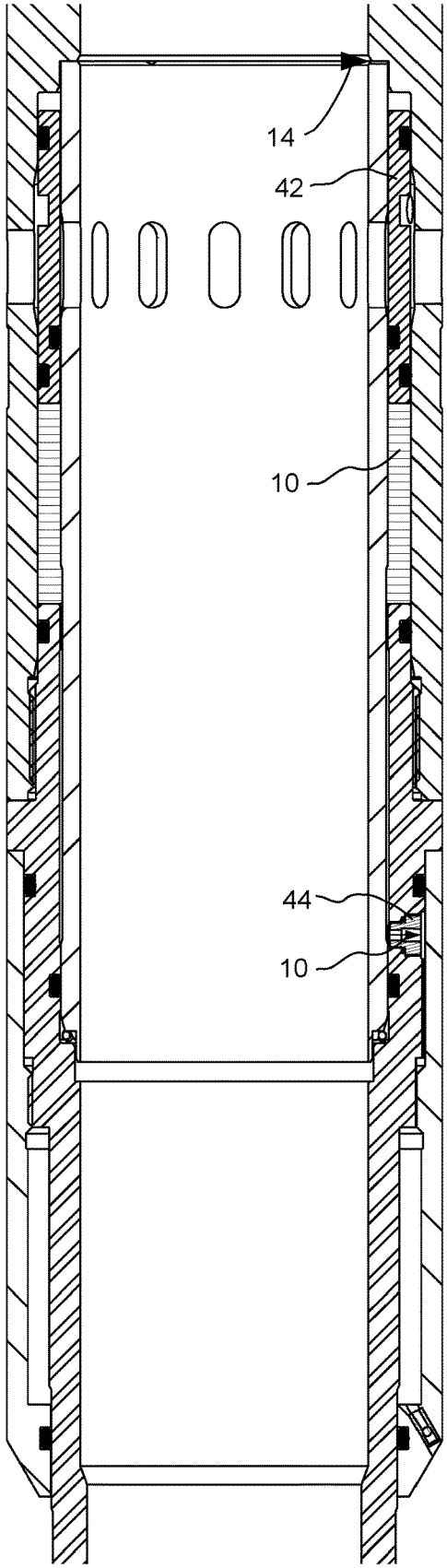
FIG. 10B illustrates the fifth toe valve in a first intermediate position while shifting from the closed position to an open position.

FIG. 10B illustrates the fifth toe valve 39 in a first intermediate position while shifting from the closed position to an open position. The toe valve 39 may be assembled as part of a casing string or a liner string and usually located in proximity to a lower end of the string. Once assembled, the casing or liner string is then deployed into the wellbore adjacent to an oil or gas bearing formation. The casing or liner string may then be cemented into position in the wellbore by pumping cement slurry down a bore thereof and up an annulus formed between the casing or liner string and the wellbore. Once the cement slurry has cured into a cement sheath in the wellbore annulus, a pressure test may be performed by pressurizing the bore of the casing or liner string to the testing pressure and holding the testing pressure for a period of time, such as between five minutes and one hour. The toe valve 39 may remain in the closed position during assembly with the casing or liner string, deployment into the wellbore, cementing of the casing or liner string, and pressure testing.

Once the pressure test has concluded, the bore of the casing or liner string may be further pressurized to an overpressure. The overpressure may be greater than the testing pressure which may be greater than the cementing pressure. The overpressure may exceed the testing pressure by an amount ranging between one-hundred five percent and one-hundred twenty-five percent. The overpressure may be equal to or greater than the set pressure of the rupture disk 44. The overpressure may be held until the toe valve 39 shifts from the closed position to the open position. Pressurized bore fluid 14 may enter the bore chamber and exert a fluid force on upper faces of the valve piston 42. The valve piston 42 in turn may pressurize the hydraulic fluid 10 in the hydraulic chamber until the hydraulic rupture disk 44 bursts, thereby opening the hydraulic control port.

FIG. 11A illustrates the fifth toe valve 39 in a second intermediate position while shifting from the closed position to the open position. Release of the hydraulic lock from the valve piston 42 allows the pressurized bore fluid 14 to push the valve piston downward. The hydraulic fluid 10 may be expelled from the hydraulic chamber into the atmospheric chamber 45.

FIG. 11B illustrates the fifth toe valve 39 in the open position. Shifting of the toe valve 39 may be complete when a lower face of the valve piston 42 engages the top of the inner housing section 40*c*, thereby providing fluid communication between the mandrel valve ports 41*v* and the housing valve ports 40*v* via the bore chamber. The mandrel bore fluid 14 may then be pumped into the formation adjacent to the wellbore by fracturing the cement sheath.

While the toe valves 1, 15, 27, 29, 39 are shown vertically oriented in the Figures, in actuality, the toe valves may be deployed in deviated, such as horizontal, portions of the wellbore so that up and down in the Figures reflects up-hole and downhole, respectively.

Alternatively, any of the toe valves 1, 15, 27, 29, 39 could be used upside down without affecting the operation thereof. Alternatively, to facilitate assembly, any of the toe valves 1, 15, 27, 29, 39 may have a fill port and/or vent port for each hydraulic chamber.

Alternatively, any of the toe valves 1, 15, 27, 29, 39 could be used with an alternative testing method. In this alternative, the rupture disks 9, 11, 28, 44 thereof may have a set pressure equal to an opening pressure. The opening pressure may exceed the cementing pressure by an amount ranging between one-hundred five percent and one-hundred twenty-five percent such that the toe valve 1, 15, 27, 29, 39 remains closed during cementing. Once cementing has concluded, the bore may be pressurized to the opening pressure, thereby opening the toe valve 1, 15, 27, 29, 39. Testing equipment, such as a test plug, may then be deployed into the casing or liner string, such as by being pumped down the bore of the casing or liner string and set or landed above the open toe valve 1, 15, 27, 29, 39. The pressure test may be performed by pressurizing the bore of the casing or liner string to the testing pressure and holding the testing pressure for the period of time while the test plug isolates the open toe valve 1, 15, 27, 29, 39 from the rest of the casing or liner string.

Alternatively, the check valve 25 may be replaced by another flow control device, such as a pressure relief valve or rupture disk.

While the foregoing is directed to embodiments of the present disclosure, other and further embodiments of the disclosure may be devised without departing from the basic scope thereof, and the scope of the invention is determined by the claims that follow.

The invention claimed is:

1. A toe valve for use in a wellbore, comprising:
a tubular mandrel;
a housing extending along a periphery of the mandrel;
couplings at longitudinal ends of the toe valve for assembly as part of a casing or liner string;
a valve piston disposed in an annulus formed between the housing and the mandrel, movable between an open position and a closed position, and disposed between a valve port of the housing and a valve port of the mandrel in the closed position;
an atmospheric chamber for facilitating movement of the valve piston to the open position;
a vent port formed through the housing and in fluid communication with the atmospheric chamber; and
a flow control device disposed in the vent port and operable to prevent fluid flow from the wellbore into the atmospheric chamber and allow fluid flow from the atmospheric chamber into the wellbore.

2. The toe valve of claim 1, further comprising:
a fastener releasably connecting the valve piston to the housing in the closed position;
a drive piston disposed between the housing and the mandrel adjacent to a drive port of the mandrel and operable to release the valve piston.

3. The toe valve of claim 2, further comprising:
a trigger piston disposed in the annulus between the valve piston and the drive piston; and
a hydraulic activator disposed between the trigger piston and the drive piston and operable to link the drive piston and the trigger piston.

4. The toe valve of claim 3, wherein:
the annulus is a lower annulus,
the toe valve further has an upper annulus formed between the housing and the mandrel,
the toe valve further comprises hydraulic fluid disposed in a drive chamber of the upper annulus adjacent to the drive piston and disposed in a trigger chamber of the lower annulus adjacent to the trigger piston, and
the hydraulic activator is in fluid communication with the drive chamber and the trigger chamber.

5. The toe valve of claim 4, wherein the hydraulic activator comprises a hydraulic port and a pressure control device disposed in the hydraulic port.

6. The toe valve of claim 3, wherein:
a valve chamber forms a portion of the annulus adjacent to the valve piston and the trigger piston, and
the valve chamber is in communication with the valve port of the housing when the toe valve is in the closed position.

7. The toe valve of claim 6, further comprising a valve spring disposed in the valve chamber.

8. The toe valve of claim 2, further comprising:
a trigger piston disposed in the annulus between the valve piston and the drive piston; and
hydraulic fluid disposed in a hydraulic chamber of the annulus adjacent to the drive piston and the trigger piston.

9. The toe valve of claim 8, further comprising a second fastener releasably connecting the trigger piston to the housing in the closed position.

10. The toe valve of claim 8, wherein:
a valve chamber forms a portion of the annulus adjacent to the valve piston and the trigger piston, and
the valve chamber is in communication with the valve port of the housing when the toe valve is in the closed position.

11. The toe valve of claim 8, wherein:
a bore chamber forms a portion of the annulus adjacent to the drive piston and a boss of the mandrel, and
the toe valve further comprises a drive spring disposed in the bore chamber.

12. The toe valve of claim 8, wherein:
the trigger piston has a stinger formed therein for engaging the valve piston, and
the housing has a shoulder formed therein for receiving the trigger piston.

13. The toe valve of claim 2, wherein the fastener is shearable and is accessible from an exterior of the toe valve.

14. The toe valve of claim 2, wherein:
the annulus is a lower annulus,
the toe valve further has an upper annulus formed between the housing and the mandrel,
the toe valve further comprises hydraulic fluid disposed in a drive chamber of the upper annulus, and
the drive port is configured to exclude debris from the drive chamber.

15. The toe valve of claim 1, further comprising:
a hydraulic activator disposed in a wall of the housing for locking the valve piston in the closed position in a first mode and for releasing the valve piston in a second mode; and
hydraulic fluid disposed in the annulus between the valve piston and the hydraulic activator.

16. The toe valve of claim 15, wherein:
the atmospheric chamber is in fluid communication with the hydraulic activator, and a face of the valve piston is in fluid communication with a bore of the mandrel.

17. The toe valve of claim 15, wherein the hydraulic activator comprises a hydraulic port and a pressure control device disposed in the hydraulic port.

18. A method of using the toe valve of claim 1 in a wellbore, comprising:

assembling the toe valve as part of the casing or liner string;

deploying the casing or liner string into the wellbore;

cementing the casing or liner string into the wellbore;

pressure testing the cemented casing or liner string by pressurizing a bore thereof, wherein the toe valve is in the closed position during the assembly, deployment, cementation, and pressure test; and after pressure testing, increasing the pressure in the bore to an overpressure, thereby shifting the toe valve from the closed position to the open position.

19. A method of using the toe valve of claim 1 in a wellbore, comprising:

assembling the toe valve as part of the casing or liner string;

deploying the casing or liner string into the wellbore;

cementing the casing or liner string into the wellbore;

increasing pressure in a bore of the casing or liner string to an opening pressure, thereby shifting the toe valve from the closed position to the open position to allow testing equipment to be positioned in the wellbore; and pressure testing the cemented casing or liner string by pressurizing the bore thereof, wherein the toe valve is in the closed position during the assembly, deployment, and cementation, and in the open position during pressure testing.

20. A toe valve for use in a wellbore, comprising:

a tubular mandrel;

a housing extending along a periphery of the mandrel;

couplings at longitudinal ends of the toe valve for assembly as part of a casing or liner string;

a valve piston disposed in an annulus formed between the housing and the mandrel, movable between an open position and a closed position, disposed between a valve port of the housing and a valve port of the mandrel in the closed position, and having a face in fluid communication with a bore of the mandrel;

a hydraulic activator disposed in a wall of the housing for locking the valve piston in the closed position in a first mode and for releasing the valve piston in a second mode;

hydraulic fluid disposed in the annulus between the valve piston and the hydraulic activator; and an atmospheric chamber in fluid communication with the hydraulic activator.

* * * * *